US008591309B2

(12) United States Patent
Fisk et al.

(10) Patent No.: US 8,591,309 B2
(45) Date of Patent: Nov. 26, 2013

(54) SYSTEM AND METHOD FOR CONSTRAINING BINGO CARD FACES TO LIMIT LIABILITY OF NUMBER OF RANDOM DRAWN WINNERS

(75) Inventors: Michael G. Fisk, Newport, RI (US); Daniel W. Bower, Atlanta, GA (US); Budd O. Libby, Atlanta, GA (US)

(73) Assignee: Scientific Games International, Inc., Newark, DE (US)

( * ) Notice: Subject to any disclaimer, the term of this patent is extended or adjusted under 35 U.S.C. 154(b) by 0 days.

(21) Appl. No.: 13/545,396

(22) Filed: Jul. 10, 2012

(65) Prior Publication Data

US 2013/0017880 A1 Jan. 17, 2013

Related U.S. Application Data

(60) Division of application No. 11/356,796, filed on Feb. 17, 2006, now Pat. No. 8,216,049, which is a continuation-in-part of application No. 10/612,782, filed on Jul. 1, 2003, now abandoned, which is a continuation-in-part of application No. 10/218,155, filed on Aug. 12, 2002, now Pat. No. 7,674,169, which is a continuation-in-part of application No. 09/900,235, filed on Jul. 6, 2001, now Pat. No. 6,592,454.

(60) Provisional application No. 60/593,835, filed on Feb. 17, 2005.

(51) Int. Cl.
*A63F 3/06* (2006.01)

(52) U.S. Cl.
USPC ..... 463/19; 463/16; 463/17; 463/18; 463/20; 463/21; 463/22; 463/23; 463/25; 463/30; 463/33

(58) Field of Classification Search
USPC ..... 463/16–23, 25, 40–42, 30–33; 273/269–274, 138.1, 138.2, 139
See application file for complete search history.

(56) References Cited

U.S. PATENT DOCUMENTS

| | | | |
|---|---|---|---|
| 4,257,107 | A | 3/1981 | Heymsfield et al. |
| 4,288,077 | A | 9/1981 | Rose et al. |
| 4,339,798 | A | 7/1982 | Hedges et al. |
| 4,429,877 | A | 2/1984 | Coppock |
| 4,494,197 | A | 1/1985 | Troy et al. |

(Continued)

FOREIGN PATENT DOCUMENTS

| | | |
|---|---|---|
| AU | 1999 30163 A1 | 1/2000 |
| AU | 2002 11974 | 8/2002 |

(Continued)

OTHER PUBLICATIONS

U.S. Appl. No. 09/900,235, filed Jul. 6, 2001, Libby et al.

(Continued)

*Primary Examiner* — Sunit Pandya
(74) *Attorney, Agent, or Firm* — Dority & Manning, P.A.

(57) ABSTRACT

A method for adapting a game of bingo to a lottery, includes predetermining a plurality of bingo faces to achieve a desired liability profile. One or more of the plurality of bingo faces are distributed. Random call numbers are generated until a desired pattern is achieved on one or more of the distributed bingo faces.

13 Claims, 14 Drawing Sheets

(56) References Cited

U.S. PATENT DOCUMENTS

| | | | | |
|---|---|---|---|---|
| 4,540,174 | A | | 9/1985 | Coppock |
| 4,651,995 | A | | 3/1987 | Henkel |
| 4,661,906 | A | | 4/1987 | DiFrancesco et al. |
| 4,689,742 | A | | 8/1987 | Troy et al. |
| 4,752,836 | A | | 6/1988 | Blanton |
| 4,768,151 | A | | 8/1988 | Birenbaum et al. |
| 4,795,161 | A | | 1/1989 | Chao |
| 4,873,585 | A | | 10/1989 | Blanton et al. |
| 4,883,636 | A | | 11/1989 | Fantle, Jr. |
| 4,909,516 | A | | 3/1990 | Kolinsky |
| 4,951,039 | A | | 8/1990 | Schwendeman et al. |
| 5,007,649 | A | | 4/1991 | Richardson |
| 5,035,422 | A | | 7/1991 | Berman |
| 5,043,887 | A | | 8/1991 | Richardson |
| 5,069,453 | A | | 12/1991 | Koza et al. |
| 5,212,636 | A | | 5/1993 | Nakazawa |
| 5,264,933 | A | | 11/1993 | Rosser et al. |
| 5,283,734 | A | | 2/1994 | Von Kohorn |
| 5,286,023 | A | | 2/1994 | Wood |
| 5,297,802 | A | | 3/1994 | Pocock et al. |
| 5,351,970 | A | | 10/1994 | Fioretti |
| 5,354,069 | A | | 10/1994 | Guttman et al. |
| 5,380,007 | A | | 1/1995 | Travis et al. |
| 5,380,206 | A | | 1/1995 | Asprey |
| 5,411,258 | A | | 5/1995 | Wilson et al. |
| 5,415,416 | A | | 5/1995 | Scagnelli et al. |
| 5,518,239 | A | | 5/1996 | Johnston |
| 5,569,082 | A | | 10/1996 | Kaye |
| 5,588,913 | A | * | 12/1996 | Hecht ..... 463/19 |
| 5,590,879 | A | | 1/1997 | Tripp |
| 5,679,007 | A | | 10/1997 | Potdevin et al. |
| 5,679,077 | A | | 10/1997 | Pocock et al. |
| 5,687,971 | A | | 11/1997 | Khaladkar |
| 5,722,890 | A | | 3/1998 | Libby et al. |
| 5,904,619 | A | | 5/1999 | Scagnelli et al. |
| 5,910,047 | A | | 6/1999 | Scagnelli et al. |
| 5,921,865 | A | | 7/1999 | Scagnelli et al. |
| 5,938,200 | A | | 8/1999 | Markowicz et al. |
| 5,951,396 | A | | 9/1999 | Tawil |
| 6,012,984 | A | | 1/2000 | Roseman |
| 6,024,641 | A | | 2/2000 | Sarno |
| 6,033,308 | A | | 3/2000 | Orford et al. |
| 6,099,407 | A | | 8/2000 | Parker, Jr. et al. |
| 6,168,521 | B1 | | 1/2001 | Luciano et al. |
| 6,193,605 | B1 | | 2/2001 | Libby et al. |
| 6,280,324 | B1 | | 8/2001 | Tenenbaum |
| 6,280,325 | B1 | | 8/2001 | Fisk |
| 6,280,328 | B1 | | 8/2001 | Holch et al. |
| 6,311,976 | B1 | | 11/2001 | Yoseloff et al. |
| 6,331,143 | B1 | | 12/2001 | Yoseloff |
| 6,358,150 | B1 | | 3/2002 | Mir et al. |
| 6,478,676 | B1 | | 11/2002 | Dayan |
| 6,530,842 | B1 | | 3/2003 | Wells et al. |
| 6,585,590 | B2 | * | 7/2003 | Malone ..... 463/19 |
| 6,592,454 | B2 | | 7/2003 | Libby et al. |
| 6,921,331 | B2 | | 7/2005 | Gatto et al. |
| 6,955,604 | B1 | | 10/2005 | Graves et al. |
| 2001/0003100 | A1 | | 6/2001 | Yacenda |
| 2002/0010012 | A1 | | 1/2002 | Dayan et al. |
| 2003/0008695 | A1 | | 1/2003 | Libby et al. |
| 2003/0087683 | A1 | | 5/2003 | Gatto et al. |
| 2003/0171986 | A1 | | 9/2003 | Itkis et al. |
| 2004/0072605 | A1 | | 4/2004 | Toyoda |

FOREIGN PATENT DOCUMENTS

| | | |
|---|---|---|
| WO | WO 94/13374 | 6/1994 |
| WO | WO 95/21425 | 8/1995 |
| WO | WO 01/08761 | 2/2001 |
| WO | WO 02/45808 | 6/2002 |

OTHER PUBLICATIONS

Koza, J.R. (1990), Genetic Programming: A Paradigm for Genetically Breeding Populations of Computer Programs to Solve Problems, Stanford University Computer Scienece Department technical report STAN-CS-90/1314.

Koza, J.R. (1992), Genetic Programming: On the Programming of Computers by Means of Natural Selection, MIT Press.

Koza, J.R. (1994), Genetic Programming II: Automatic Discovery of Reusable Programs, MIT Press.

Koza, J.R. Bennett, F.H., Andre, D., and Keane, M.A. (1999), Genetic Programming III: Darwinian Invention and Problem Solving.

Morgan Kaufmann, Koza, J.R., Keane, M.A., Streeter, M.J., Mydlowec, W., Yu, J., Lanza, G. (2003), Genetic Programming IV: Routine Human-Competitive Machine Intelligence, Kluwer Academic Publishers.

* cited by examiner

Wait for interrupt
S100
S102
Station type ?
VENDOR
KIOSK
S104
Prompt user to insert payment card
S106
Card Verified?
YES
NO
S108
Display invalid card message
S110
Prompt operator to enter data
S112
Store data
S114
Additional data?
YES
NO
S116
Obtain ID data
S118
Assign time tag
S120
Store ID and time tag data
S122
Send data
S124
Wait for reply
S126
Data valid ?
NO
S128
Display error message
S130
Print receipt

SYSTEM AND METHOD FOR CONSTRAINING BINGO CARD FACES TO LIMIT LIABILITY OF NUMBER OF RANDOM DRAWN WINNERS

CROSS-REFERENCE TO RELATED APPLICATIONS

This application claims the benefit of U.S. Provisional Application No. 60/593,835, filed Feb. 2, 2005, the entire contents of which are herein incorporated by reference.

The present application is a Divisional Application of U.S. patent application Ser. No. 11/356,796, filed Feb. 17, 2006; which is a Continuation-in-Part of U.S. patent application Ser. No. 10/612,782, filed Jul. 1, 2003, which is a Continuation-in-Part of U.S. patent application Ser. No. 10/218,155, filed Aug. 12, 2002, which is a Continuation-in-Part of U.S. patent application Ser. No. 09/900,235, filed Jul. 6, 2001, now U.S. Pat. No. 6,592,454.

FIELD OF THE INVENTION

The present invention relates to generating bingo card faces, and more particularly to generating bingo card faces that are constrained to limit liability of the number of random drawn winners.

BACKGROUND OF THE INVENTION

Many states have used lottery or on-line games, such as number games (for example, Pick 3, Pick 4, Lotto, Mega Millions, etc.) and "instant winner" games, as an added source of revenue. These games have become quite popular and successful.

One type of state-run lottery game involves the use of numerous remote computer stations located in stores throughout the state which communicate with a central computer. A customer seeking to play the game may mark the numbers he wishes to enter as his choices on a computer scannable or readable entry form. The customer pays the entry fee, usually no more than a few dollars, and the store clerk feeds the entry form into a card reader controlled by a lottery computer station or terminal, which registers the numbers selected and an ID number in the central computer. Alternatively, the customer may choose several numbers, and the store clerk may enter the chosen numbers into the lottery computer by operating a keypad. In another variation, the customer may elect a Quick-Pick option that provides for random selection of the customer's numbers by a computer.

After wagering has been closed to new entries, a carefully monitored selection committee chooses the winning numbers. This may involve, for example, operating a machine loaded with balls having eligible numbers marked thereon to select at random the appropriate number of balls. This selection process often is broadcast on local television stations so that contestants can watch to see if their numbers have been selected.

Bingo is another popular form of gaming, in which participants engage as a pastime activity and/or in order to pursue their desire to wager. Each player in a bingo game receives a bingo card, which, in a traditional form of bingo, is a preprinted card. The card contains a matrix of locations or spaces. As an example, a typical bingo card has a matrix of five rows and five columns of spaces, and each space has a corresponding bingo number (in a range of 1-75) printed in the space. As the bingo game is played, bingo numbers are drawn at random and "called" (i.e. announced to all of the players). If a called number matches any of the numbers on a player's card (i.e. the number is a "hit"), the player marks the space bearing that number. In order to win a bingo game, a player must achieve a predetermined winning pattern of hits (i.e. marked spaces) on his/her bingo card. The bingo cards may have one or more "free" spaces, which do not have a number and can form part of a winning pattern without being hit by any of the called bingo numbers.

Each game of bingo can have one or more winning patterns, as determined by the game's administrator (i.e. master of ceremonies or MC). The MC typically announces the selected pattern prior to commencement of the game. For example, in a typical game utilizing five-by-five bingo cards, the MC might announce that the winning pattern consists of hits in the five spaces in one row or column of the bingo card, or in the five spaces in one of the two main diagonals of a bingo card. In another game, the MC might announce that the winning pattern consists of hits in the four corner spaces of a bingo card.

In addition, a game may have progressive winning patterns. For example, once a player obtains hits on all of the corner spaces of his/her bingo card and collects a prize for that winning pattern, the game continues until a player obtains hits on the entire outside border of a bingo card, at which time a second prize is awarded. As another example of progressive winning patterns, the progressive winning patterns may consist of Letter X (FIG. 9A), Sputnik (FIG. 9B) and Blackout (FIG. 9C) patterns. Progressive winning patterns are typically announced in advance or as a game progresses, in order to maintain the interest of the players in the game.

A traditional bingo game is typically played in a single location, such as a bingo hall. In this traditional arrangement, players enter the game by purchasing or otherwise obtaining one or more bingo card which may be selected from a group of available cards, and then taking a seat in the bingo hall. Thereafter, the player monitors called numbers and marks his/her card(s) appropriately. It is a typical rule that when a player achieves a winning pattern of hits, the player must call out "bingo" in order to claim a prize. This rule encourages players to pay active attention to the game. When the player announces "bingo", the player's card is compared to the called numbers to confirm that the player has won.

Bingo players who wish to increase their odds of winning may purchase multiple bingo cards (sometimes even half a dozen or more cards).

Many electronic and electromechanical devices have been proposed for assisting players with multiple bingo cards to keep track of their cards during a bingo game. See, for example, U.S. Pat. Nos. 4,651,995, 4,661,906 and 4,768,151, which are incorporated herein by reference. In addition, others have proposed computer-based systems for automating bingo games. See, for example, U.S. Pat. Nos. 4,909,516, 5,007,649, 5,043,887, 5,297,802, 5,351,970, 5,679,007, 5,687,971 5,904,619, 5,910,047, 5,921,865, 5,951,396, 6,024,641, 6,099,407 and 6,280,325, also incorporated by reference herein. Lottery bingo games, like other state-run lottery games, have been adapted for broadcast to a broad audience.

Integrity of the winner selection process significantly increases the cost of running lottery bingo games and other lotteries. For example, each broadcasted drawing conventionally requires several individuals (e.g., a host or hostess, an auditor, a camera crew, and a set-up crew) to be present, and a television studio equipped with camera and lighting equipment.

In addition, states and other entities running such lottery games have experienced some difficulties in increasing the number of interested day-to-day participants, and in maintaining the day-to-day interest of those who do participate on a regular basis.

As a result, a need exists for an automated lottery game which complies with government regulations without requiring extensive commitment of human and other resources, and which also enhances the intrinsic excitement of the game, in order to maintain and preferably increase the playing population.

In adapting bingo to the large-scale of state lottery games, the extraordinarily large number of possible bingo card configurations makes it very difficult to predict how many players may win at the same time. Unlike standard lottery games where the chances of having two or slightly more players simultaneously winning a game is rare and the chances of having an even larger number of players simultaneously win a game is nearly infinitesimal, the dynamics of bingo allow for a significant probability that a great number of players will simultaneously win a game.

Because all winning players share a prize, the potential for a great number of winners can significantly detract from the allure of the lottery where excitement is generated by the possibility of winning a large payout.

There is a desire to utilize a system and method for adapting bingo for a large-scale lottery in such a way as to obtain a liability profile that retains the allure of traditional lottery games.

SUMMARY OF THE INVENTION

The present invention overcomes these and other disadvantages of prior games and provides a bingo game generator for a lottery bingo game, which comprises, according to one embodiment, an animation drawing subsystem. The animation drawing subsystem selects bingo call video segments corresponding to a sequence of bingo numbers randomly drawn for a bingo game, and compiles the bingo call video segments into a bingo game video. One or more pre-recorded video segments of an announcement of the bingo game result by a real person may be integrated in the bingo game video.

This disclosure also provides a lottery bingo system graphically portraying an animated bingo game, which comprises, in one embodiment, the bingo game generator and at least one lottery terminal configured to dispense bingo tickets to a player. The animation drawing subsystem retrieves bingo call video segments corresponding to a sequence of drawn bingo numbers randomly drawn for a bingo game, and compiles the bingo call video segments into a bingo game video.

The invention also provides a method of conducting an animated lottery bingo game comprising of comparing a sequence of drawn bingo numbers, which are randomly drawn for a bingo game, to bingo game numbers on a plurality of tickets to determine winning tickets and a winning sequence of bingo calls, retrieving matched video segments corresponding to the winning sequence of bingo calls, and compiling the retrieved matched video segments into a bingo game video.

The sequence of drawn bingo numbers may be randomly drawn and then compared to the bingo game numbers on the plural tickets sold. Alternatively, the comparison may be performed after each number is randomly drawn, with the drawing-followed-by-comparison process being iterated until one or more winners are determined.

The invention further provides a method for adapting a game of bingo to a lottery, includes predetermining a plurality of bingo faces to achieve a desired liability profile. One or more of the plurality of bingo faces are distributed. Random call numbers are generated until a desired pattern is achieved on one or more of the distributed bingo faces.

The invention additionally provides a method for adapting a game of bingo to a lottery that includes randomly generating a plurality of bingo faces. One or more bingo faces are randomly selected from the plurality of bingo faces to become winning faces to achieve a desired number of wining faces. A set of call numbers that allow the selected faces to win are constructed.

The invention likewise provides a method for adapting a game of bingo to a lottery that includes randomly generating a set of call numbers. A desired number of winning bingo card faces are constructed based on the generated set of call numbers. A desired number of losing bingo card faces are constructed based on the generated set of call numbers.

The invention also provides a system for adapting a game of bingo to a lottery that includes a bingo-face predetermining unit for predetermining a plurality of bingo faces to achieve a desired liability profile. One or more distribution units distribute one or more of the plurality of bingo faces. A call number generation unit generates random call numbers until a desired pattern is achieved on one or more of the distributed bingo faces.

The invention also provides a system for adapting a game of bingo to a lottery that includes a bingo face generating unit for randomly generating a plurality of bingo faces. A selection unit randomly selects one or more bingo faces from the plurality of bingo faces to become winning faces to achieve a desired number of wining faces. A call number set construction unit constructs a set of call numbers that allow the selected faces to win.

The invention additionally provides a system for adapting a game of bingo to a lottery system that includes a call number set generating unit for randomly generating a set of call numbers. A winning bingo card face constructing unit constructs a desired number of winning bingo card faces based on the generated set of call numbers. A losing bingo card face constructing unit constructs a desired number of losing bingo card faces based on the generated set of call numbers.

BRIEF DESCRIPTION OF THE DRAWINGS

The above and numerous other objectives, features and advantages that may be achieved by the subject matter of the present invention may be more readily understood from the following detailed description of the preferred embodiments by referring to the accompanying drawings wherein.

DETAILED DESCRIPTION OF THE INVENTION

Figure 1A:
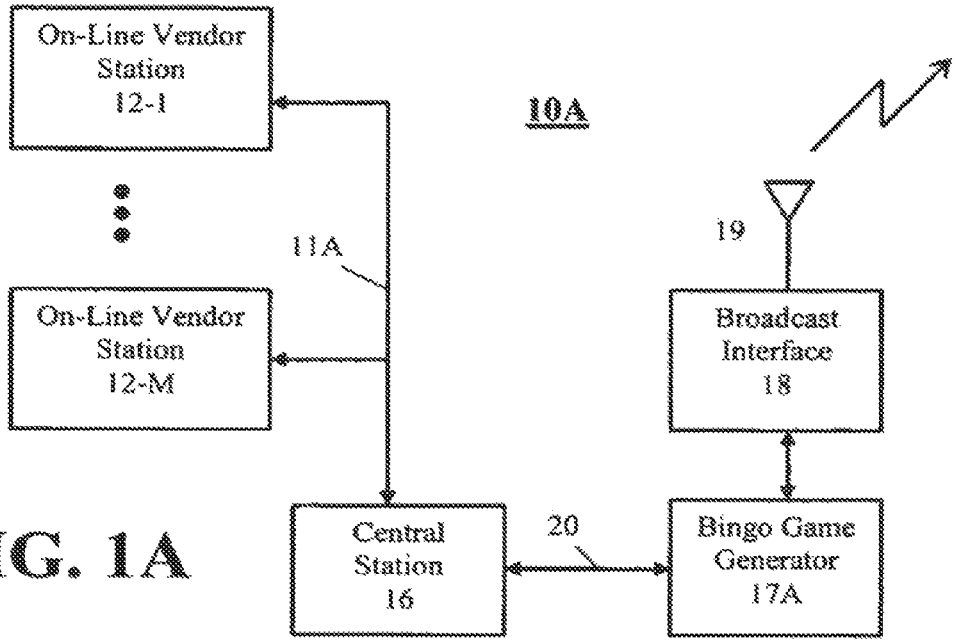
FIG. 1A is a block diagram of a lottery bingo system, according to one embodiment of the present invention.

The present invention provides tools (in the form of systems, apparatuses and methodologies) for automating and animating lottery bingo games, which may be used to avoid the expenses of allocating facility, equipment and a staff of individuals to each bingo drawing. The lottery drawing may be automated and the results of the drawing graphically portrayed in animation and/or in video, as a virtual ball draw or another form of an animated bingo drawing. Optionally, announcement of the winning numbers (or other game parameters) by a real person in one or more pre-recorded video segments may be integrated with the animated game result. Accordingly, a computerized lottery or wagering system embodying the subject matter of this disclosure includes a bingo game generator which provides random selection of a sequence of drawn bingo numbers and compilation of an animated lottery game bingo video.

A lottery bingo system 80 graphically portraying an animated bingo game, according to one embodiment (FIG. 8A), includes a bingo game generator 81 and lottery terminals 83-1, . . . , 83-N, each of which is configured to dispense bingo tickets to a player.

The bingo game generator 81 includes an animation drawing subsystem 81*a*. The animation drawing subsystem 81*a* selects bingo call video segments corresponding to a sequence of bingo numbers randomly drawn for a bingo game, and compiles the bingo call video segments into a bingo game video. One or more pre-recorded video segments of an announcement of the bingo game result by a real person may be integrated in the bingo game video.

The lottery bingo system may optionally include a ticket validation module 85. Each bingo ticket is associated with a corresponding ticket identifier, and the ticket validation module stores game data for each ticket, including the ticket identifier and the bingo game numbers for the ticket. The ticket validation module compares the sequence of drawn bingo numbers to the bingo game numbers on a plurality of tickets to determine winning tickets and a winning sequence of bingo calls. The animation drawing subsystem retrieves matched video segments corresponding to the winning sequence of bingo calls which are determined by the ticket validation module and compiles the matched video segments into the bingo game video.

Figure 8A:
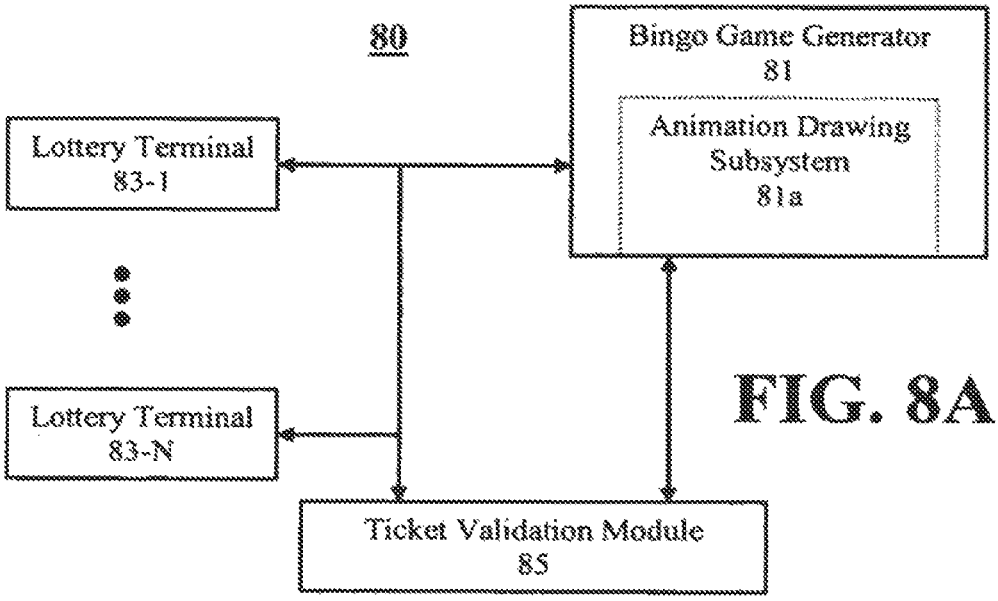
FIG. 8A a block diagram of a lottery bingo system, according to one embodiment of the present invention.
Figure 8B:
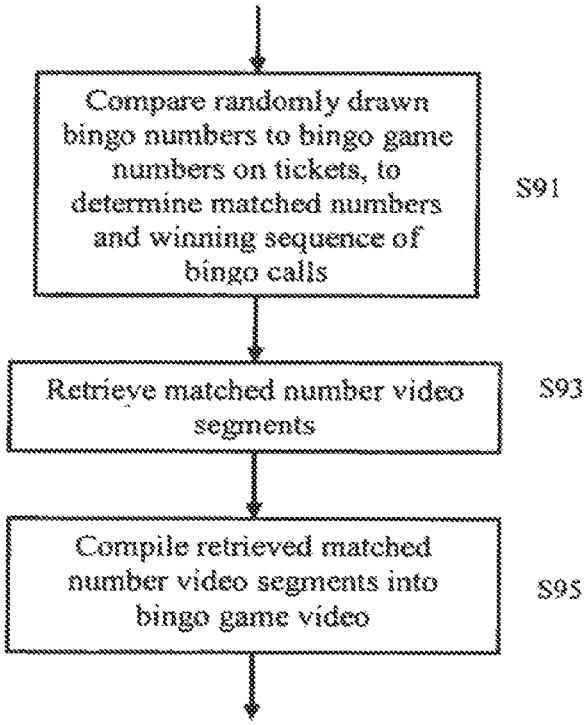
FIG. 8B is an exemplary flow diagram showing a method of conducting an animated lottery bingo game.

A method of conducting an animated lottery bingo game, according to one embodiment, will be explained with reference to FIGS. 8A and 8B. A sequence of drawn bingo numbers randomly drawn for a bingo game after dispensing of bingo tickets for the bingo game is ended at lottery terminals 83-1, . . . , 83-N, is compared by the ticket validation module 85 to bingo game numbers on a plurality of tickets to determine winning tickets and a winning sequence of bingo calls (step S91). Matched video segments corresponding to the winning sequence of bingo calls are retrieved by the animation drawing subsystem 81 a (step S93). The retrieved matched video segments are compiled by the animation drawing subsystem 81*a* into a bingo game video (step S95).

A player typically is issued a ticket bearing bingo game numbers configured in a matrix as on a conventional bingo card. Each issued ticket may be assigned a unique multi-digit identifier which identifies the ticket with the matrix or matrices of bingo game numbers on the ticket. The identifiers of issued tickets are stored for selective retrieval. After wagering is closed, a sequence of drawn bingo numbers is randomly selected.

In order to create high churn (i.e. different ways to win) to stimulate interest, a lottery bingo game may have multiple winning patterns which are selected prior to the drawing, or progressive winning patterns which are announced in advance or as a game progresses.

Figures 9A, 9B, 9C:
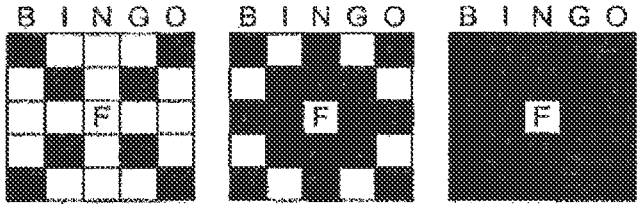
FIGS. 9A through 9C show schematic representations of Letter X, Sputnik and Blackout winning patterns, respectively.

For example, the progressive winning patterns may include hits on all of the corner spaces of a bingo card for one prize, and hits on the entire outside border of the bingo card for another prize. As another example, the progressive winning patterns may consist of Letter X (FIG. 9A), Sputnik (FIG. 9B) and Blackout (FIG. 9C) patterns. The first player(s) to achieve a Letter X winning pattern receives a share of the $3^{rd}$ prize, the first player(s) to achieve a Sputnik winning pattern receives a share of the $2^{nd}$ prize, and the first player(s) to achieve a Blackout winning pattern receives a share of the first prize.

In order to maintain the interest of players who do not win the first, second or third prize, additional prizes may be awarded. For example, additional prizes may be awarded to players randomly picked from total player base, or players who were one, two or three calls away from having a winning pattern.

Optionally, a bingo ticket or card may include multiple matrices (also referred to as "faces" or "boards"). For example, a bingo card may have three faces. This allows for a number of different playing methods: (i) all three faces are played separately, with each face being for a different independent game; (ii) all three faces are played together in the same game; and (iii) all three faces are played together in the same game, but prizes are awarded to the winners by face.

For method (i), there are three independent draws and each draw is played against a different face on the card. The first draw is played against only the top face on all of the cards. The second draw is played against the middle face on all of the cards. The third draw is played against the bottom face on all cards. In each draw, players would have a chance to win one of the three prizes.

For method (ii), there is only one draw played against all three faces on the card. Players have three chances to win. This is similar to conventional bingo as players tend to play many cards at once.

For method (iii), there is only one draw played against all three faces on the card. However, prizes are awarded to the first player to match a pattern on each of the three different faces (i.e. the top face, the middle face and the bottom face).

If progressive winning patterns are added to the mix, there are nine chances to win, and the player can win up to three times on each face of the card. However, a limitation may be added so that although each card may win more than once, the player cannot win more than one prize on each game card and only the highest winning prize of each game card will be awarded to the player.

The bingo games may take place periodically at virtually any interval, e.g., one-game-per-half-hour, one-game-per-day, one-game-per-week, etc. If the games are broadcasted on public, cable or satellite television, the frequency of broadcasted games, of course, depends in part on program scheduling of the television station. The bingo game video may be published on a web site to which ticket holders connect to participate in a simulated bingo ball game.

A grand prize may optionally be provided. According to one embodiment, the identifiers of all winning bingo tickets are selectively retrieved. One of the retrieved identifiers may be randomly selected to determine a grand prize winner. Alternatively, the grand prize winner may be selected from the pool of all non-winners or all players of the lottery bingo game.

The bingo game generator, according to one embodiment, may be an on-line bingo module (OLBM) which may be integrated within an existing (for example, state-run) lottery system.

The OLBM may be a digital solution for playing, validating, and delivering lottery-draw entertainment content, which enables jurisdictions (such as states) to provide ticket holders with an interactive gaming experience over the Internet.

The OLBM can include random number generation, animation, media delivery, and game play and validation.

The OLBM can be adapted for the following exemplary lottery environments: (a) Single State/Single Game: a single state employs the OLBM to conduct one or more drawings on a daily or weekly basis; (b) Multiple States/Single Game: Multiple states individually employ the OLBM to conduct one or more separate drawings on a daily or weekly basis; and (c) Multiple States/Multiple Games: Multiple states will each play their own game ticket universe based on numbers drawn from a common source.

Within each of these scenarios, the procedures by which the game is conducted are fundamentally identical. For any given drawing, the on-line ticket sales systems for each participating state are configured to sell tickets from a specified "universe" (i.e. a large, enumerated collection of bingo cards). In scenario (a), the universe is the same for all states. In scenario (b), the universe may differ on a per state basis. At the close of ticket sales, each participating state's on-line ticket sales system reports to the OLBM an enumerated list of tickets sold within its jurisdiction. Once all states have reported, the OLBM electronically generates, in a fair, random manner, a complete series of seventy-five (75) bingo calls. The OLBM then uses these results to automatically determine the winning tickets (if any) in each state. In scenario (b), the tickets from all participating states are scored together as in any multi-jurisdictional drawing. In scenario (c), the tickets from each state are scored separately and independently. Finally, the OLBM publishes an enumerated list of winning tickets, along with the winning sequence of bingo calls (or the entire sequence of drawn bingo numbers), to the on-line ticket accounting systems in each participating state. Optionally, at the same time, the OLBM can publish the game information to a database server which can make the game information available to the Internet public via the World Wide Web.

Figure 10:
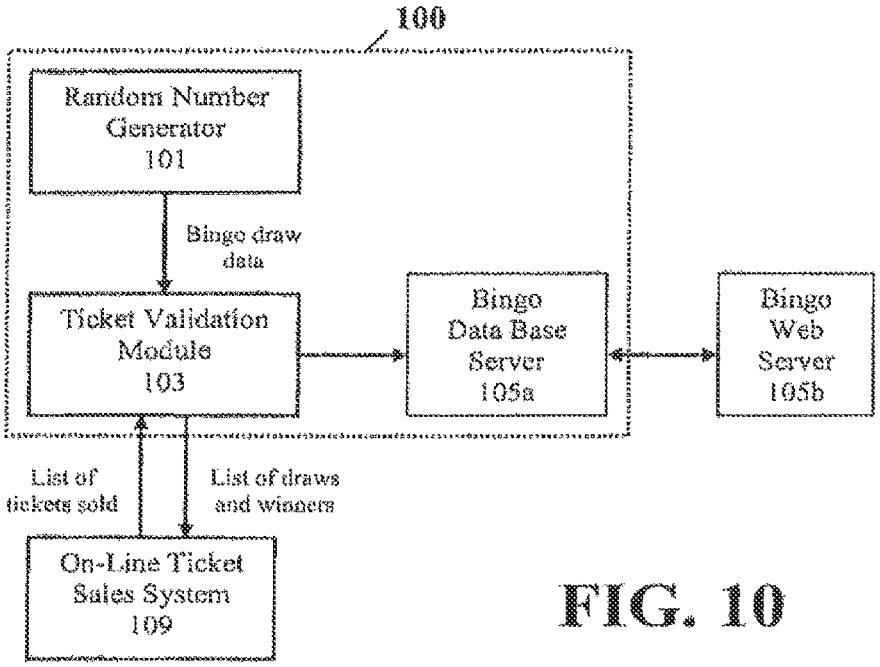
FIG. 10 shows a block diagram of an on-line bingo module, according to one embodiment of the present invention.

An OLBM 100, according to one embodiment (FIG. 10), may include a random number generator (RNG) 101 and a ticket validation module (TVM) 103. Additionally, for each jurisdiction which chooses to publish the draw information on the Internet, the OLBM can include an Internet publishing subsystem 105 which includes a bingo database server module 105*a* and at least one bingo web server 105*b*. A block diagram of the OLBM 100 interfacing with genetic lottery facilities 109 is shown in FIG. 10.

In the case of scenario (a), the RNG 101 and the TVM 103 can be co-located at a secure state facility. In the case of scenarios (b) and (c), the RNG 101 and the TVM 103 modules can be distributed, with a single RNG located at a mutually agreeable secure facility and a TVM located at each participating state's secure facility.

The random number generator 101 can be based on the industry-standard Automatic Draw Machine currently supplied to several state lotteries. The RNG electronically generates a complete series of seventy-five (75) bingo calls in an unbiased and unpredictable fashion. Thus, the RNG generates winning numbers (or values) that are appropriate for the range of each game, the method of generating the winning numbers (or values) is unbiased and unpredictable, the RNG is secure and cannot be altered without discovery, and the process of transferring the winning numbers (or values) from the RNG to the validation process (usually on the central gaming system) is protected against error or malice.

The Ticket Validation Module 103, which receives as input enumerated lists of tickets sold in each jurisdiction, employs, in sequential order, a portion or all of the complete series of seventy-five (75) bingo calls generated by the RNG to determine which, if any, of the tickets are winning tickets. This validation process is completely automatic, and can be performed for very large sets of tickets with nearly instantaneous results. The TVM records detailed game data on a per-ticket basis, enabling states to offer associated electronic entertainment products (for example, bingo game video) in conjunction with their standard drawings. The game data allows a state, for instance, to publish a web site to which ticket holders can connect and play their tickets as if they were participating in a bingo hall game. Since all of the winners are indisputably determined at the time of the drawing, such simulated bingo hall activities would be for postdrawing entertainment purposes only (for example, after five calls, there are two tickets purchased for the current drawing that are only two calls away from being winners). It is not necessary for a ticket holder to visit such a web site, or actively play his/her tickets in any other manner in order to be eligible to win.

The Internet publishing subsystem 105 receives the draw information from the TVM 103, stores the draw information and provides it, on demand, over the Internet when requested by web browsers. The draw information is received from the TVM by the bingo data base server 105*a* component of the Internet publishing subsystem 105. The bingo data base server 105*a* can be housed in a different computer system from the bingo web server(s).

The number of bingo web servers may be selected according to the anticipated loads imposed by the enquiring web browsers. One of the benefits of employing a separate bingo web server to display data publicly from a secured database is that the data base server is not exposed to the Internet. For users to request a page, the web server must reside in a zone that is outside of the lottery firewall. From this position outside the firewall, the web server can publicly serve web pages without exposing information (for example, name, address, user account name and password, etc.) required to connect to the data base server.

In most common scenarios, the computer which contains the data base server resides behind the lottery firewall on a private network. When a user requests a page, the web server, not the Internet user, initiates contact with the database. On platforms such as Windows 2000 or Unix/Linux, this connection occurs at the operating system security level. Depending upon the system design, many additional authentication layers can exist between the Web server and the database server, including both firewall authentication and secured data base login. In most cases of high security, the web server can only connect to the data base through a valid operating system user account on the private network behind the firewall.

A user connecting to the web server from the Internet cannot see the data base server, nor does the user have the information or capability to log onto the database server directly. In essence, the data base server is transparent to the Internet user, and the data displayed is under the complete control of the system.

An on-line ticket sales system provides an enumerated list of tickets sold in its jurisdiction to the Ticket Validation Module 103. This interface can be implemented using a means of electronic transfer, via recordable media (disk, CD, or DVD) or manually.

The TVM 103 can provide an enumerated list of winning tickets, as well as the winning sequence of bingo calls (or the entire sequence of drawn bingo numbers) to the on-line ticket accounting system in each participating jurisdiction. If a jurisdiction publishes the draw information on the Internet, there is an additional interface from the TVM 103 to the Internet publishing subsystem 105. The interfaces can be implemented using a means of electronic transfer, via recordable media (disk, CD, or DVD) or manually.

An interface between the RNG 101 and the TVM 103 is mono-directional, or read-only, thereby ensuring that the TVM 103 can receive draw data from the RNG without having the capacity to write data in the opposite direction. This interface can be implemented using a means of electronic transfer, a mono-directional serial interface, via recordable media (disk, CD, or DVD) or another secure technique (such as via facsimile transmission).

The OLBM centralizes the generation of the series of bingo calls by utilizing a single RNG. Therefore, synchronization is not an issue as there is a single source that performs the random number generation for all drawings.

Each jurisdiction is responsible for maintaining the bingo data base server component of their Internet publishing subsystem, in order to ensure synchronicity of the results of a given draw as displayed on the Internet.

Due to the lack of external interfaces, the OLBM is inherently secure. As long as the interchange of information between the TVM and the online ticket sales and accounting systems for each state is safeguarded by normal security means (i.e., physical access to the machines is controlled, transfers of information occur over secure links such as facsimile machines and via CDs or DVDs, etc.), no opportunity exists for malicious programmers to access the OLBM.

The connection between the bingo data base server component and the web Server component of the Internet publishing subsystem is preferably configured so as to prevent external access during the brief period of time that the bingo data base server component is being updated with draw results by the TVM. While the draw results are being published by the data base server component, through the web server component, the connection between the data base server and the TVM is severed, in order to minimize the opportunities for malicious programmers to gain access to data that should be protected.

Upon completion of the ticket validation process, the TVM will hold all information necessary to uniquely identify any and all of the winning tickets within each state. The exact method by which each state is notified may depend on the on-line ticket accounting systems access policies and procedures of the involved organizations. In any event, the OLBM reliably informs jurisdictions of confirmed winners in a secure and timely manner through various forms of electronic transmission or recordable media.

A block diagram of a lottery bingo system, according to another embodiment, is shown in FIG. 1A. Lottery bingo system 10A includes a plurality of remote on-line vendor stations 12 that are linked over a wide area network (WAN) 11A to a central station (or server) 16. A bingo game generator 17A is connected to the central station 16 over a computer or telecommunicative network 20 (such as the Internet). In the embodiment corresponding to FIG. 1A, the central station 16 acts as an interface between the bingo game generator 17A and the remote on-line vendor stations 12. As a result, the bingo game generator can connect to existing lottery bingo systems (for example, run by respective states) having a plurality of remote on-line vendor stations connected to a central station (or server). The central station serves as a communication interface for transferring the selected bingo game parameters from the remote vendor stations to the bingo game generator, and for transferring data regarding the randomly selected sequence of drawn bingo numbers from the bingo game generator to the remote vendor stations.

In another embodiment, the bingo game generator may communicate directly with the remote vendor stations. In an embodiment corresponding to FIG. 1B, bingo game generator 17B in lottery system 10B is connected directly to a plurality of remote vendor stations 13 via WAN 11B (or the Internet). The bingo game video may be transmitted via, for example, a closed circuit television line. In this embodiment (FIG. 1B), the system does not need to be connected to an existing lottery system.

Bingo boards are preferably obtained through Quick-Picks.

Figure 1B:
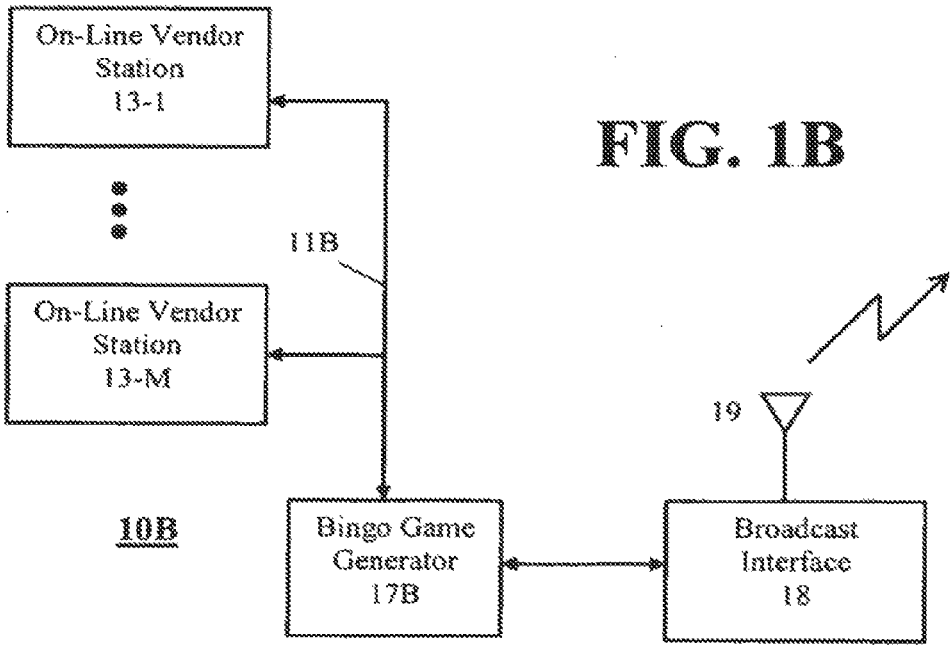
FIG. 1B is a block diagram of a lottery bingo system, according to another embodiment of the present invention.

As an option in the embodiments exemplarily shown in FIGS. 1A and 1B, the remote vendor stations may be configured to provide on a graphic display a choice of bingo boards, bearing respective unique combinations of numbers, to a player for selection using one or more input devices such as, for example, a keyboard or key pad.

Typically, bingo board selection may be performed by an operator of the remote vendor station. Alternatively, if a kiosk type of remote station is used, the player can directly select the bingo board. In another embodiment, the player may be provided with an option of specifying the desired numbers on the bingo board which the player wishes to obtain. For example, the remote (vendor or kiosk-type) station may include a scanner for scanning a lottery entry form bearing player-selected bingo numbers.

In any event, the remote station transfers the selected bingo game parameters (including board identifier and/or bingo game numbers on the board) to the game generator either directly (FIG. 1B) or via the central station (FIG. 1A).

Figure 1C:
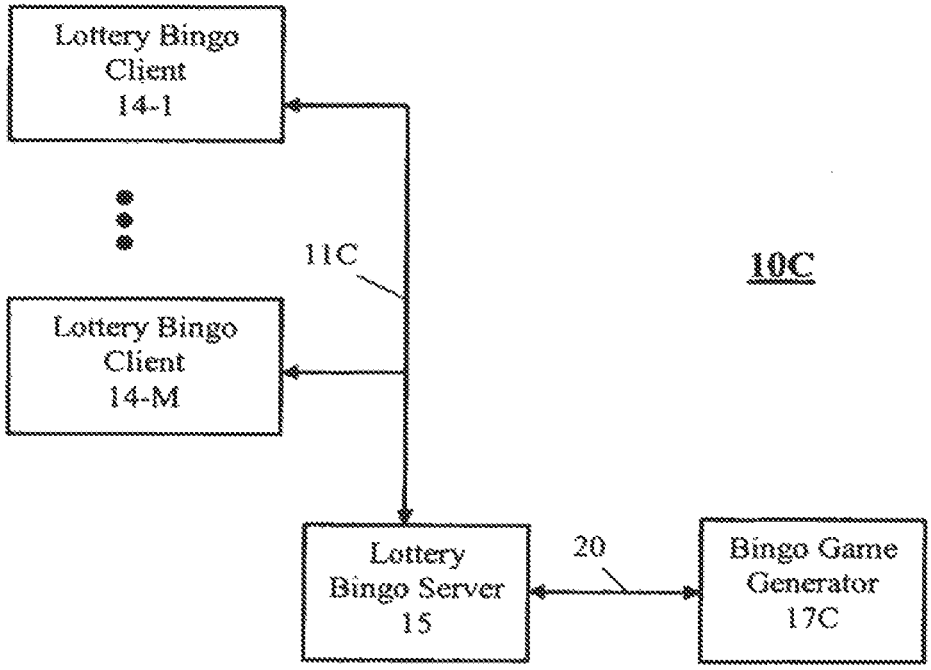
FIG. 1C is a block diagram of a lottery bingo system, according to a third embodiment of the present invention.

According to another embodiment, the bingo game generator may be integrated in a client-server lottery bingo system (FIG. 1C). Lottery bingo service is provided by a lottery bingo server 15, across WAN 11C (for example, the Internet), to a plurality of lottery bingo clients 14. Bingo game generator 17C is coupled to lottery bingo server 15. A client terminal may have a display, on which a choice of bingo boards are displayed for selection, and one or more input facilities, such as a keypad, interactive voice interface, etc., through which a player can specify the desired board. However, as mentioned above, bingo boards are preferably obtained through Quick-Picks.

Figure 2A:
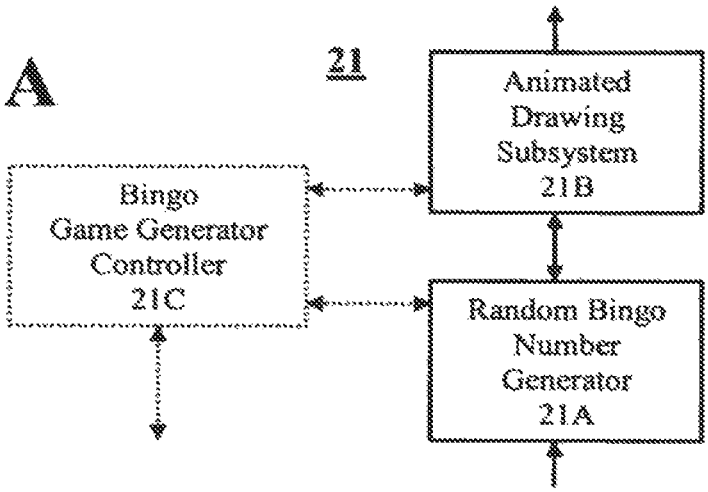
FIG. 2A is a block diagram of a bingo game generator, according to one embodiment of the present invention.

The bingo game generator preferably is a random, animated digital drawing system (RADDS). As shown in FIG. 2A, RADDS 21 includes a random bingo number generator 21A, an animated drawing subsystem (ADS) 21B and an optional bingo game generator controller 21C.

The random bingo number generator may be a hardware based number generator or a program based number generator, and either stand alone or integrated into the bingo game generator. Alternatively, an operator can randomly select the drawn bingo numbers and enter the numbers via a keyboard.

The random bingo number generator can select any number of picks from a set of bingo numbers. For example, with 75 numbers in the set, the random number generator can draw a sequence of anywhere from 1 to 75 numbers from the set.

The ADS 21B (FIG. 2A) includes a library of virtual images, animation elements and/or recorded video images.

In the embodiments corresponding to FIGS. 1A-1C, at a predefined time for each corresponding game, selection of game boards is ended for the game. The random number generator, automatically or when specified by an operator, randomly selects a bingo number. After the number is drawn, the drawn bingo number is forwarded to the bingo game generator. The bingo game generator performs a ticket validation process to compare the sequence of drawn bingo numbers to the stored bingo game parameters in order to determine if there is a winning ticket(s) and the portion of the bingo calls which resulted in the corresponding match of the winning pattern (referred to herein as "winning sequence"). Bingo numbers are drawn, forwarded, and compared until a winner(s) is determined Next, selected virtual images and animation elements corresponding to the winning sequence of bingo calls are retrieved and composed into animation sequences.

For example, the animated lottery game may be fashioned as an animated, virtual ball draw. As mentioned above, bingo drawings are often conducted by using a machine loaded with numbered plastic balls or other numbered pieces. However, the expense of undertaking such conventional drawings is great since a collection of audio-video equipment and a staff of personnel must be allocated for each drawing. The virtual draw does not require such expense and resource allocation, after the initial setup, since it can be automated. Further, automation of the drawings also facilitates auditing and archiving, since human input is removed from the automated process.

When the sequence of drawn bingo game numbers is randomly selected, animation segments corresponding to the numbers in the sequence are retrieved from the library of the ADS 21B, and the animation segments are composed into a video sequence. Alternatively, animation segments corresponding to the winning sequence of bingo calls are retrieved from the library of the ADS 21B, and the animation segments are composed into a bingo game video.

Thus, for example, if a winning sequence of bingo calls includes 29, 3, 17, . . . , an animation segment corresponding to virtual draw of a number twenty-nine ball, an animation segment corresponding to virtual draw of a number three ball, and an animation segment corresponding to virtual draw of a number seventeen ball are retrieved from the library and appended one to another and to the animation segments corresponding to virtual draw of other numbers in the sequence, to provide a virtual draw of the twenty-nine, three and seventeen balls within a sequence. In order to provide some variety, the library may store a number of variations of the virtual drawing of each numbered ball. For example, color and design may vary. When the number twenty-nine appears in the sequence of drawn bingo numbers, one of the plural animation segments corresponding to virtual drawing of the number twenty-nine ball is selected and retrieved from the library.

In addition, the ADS 21B may optionally include a real people announcement component, and the animated lottery game video thereby includes announcement of the sequence of drawn bingo numbers by a real person in one or more pre-recorded video segments. For example, for each drawn bingo number, announcement by a real lottery spokesperson of selection of the number for the sequence of drawn bingo numbers may be pre-recorded in a video segment, and the video segment is stored in the library.

Further, the video segment may be associated with the animation segment (also stored in the library) corresponding to the virtual draw of the corresponding numbered ball, and when the animation segment is retrieved, the associated video segment of the real person announcement is also retrieved. The virtual ball draw and the real person announcement may be displayed simultaneously (and synchronously), for example, in a split screen.

The terms "video segment" and "animation segment" are used broadly herein (including in the appended claims) to cover the possibility of including audio tracks with the video or animation. According to one embodiment, an audio track may be integrated with a video segment. In another embodiment, when video segments are selected and compiled, the selection and compilation process also includes independently selecting and compiling audio tracks. A variety in the available audio tracks, like variations in video and animation, contributes to the intrinsic excitement of the game.

In embodiments in which animated game events are broadcasted (for example, corresponding to FIGS. 1A and 1B), an animation sequence corresponding to the winning sequence of bingo calls may be retrieved, formatted for broadcast, and broadcasted using standard television transmission techniques via, for example, RF transmission, microwave transmission, fiber optic cabling or closed circuit television lines, so that the players can watch the game on a television and root for their selections. Alternatively, the animation sequence corresponding to the winning sequence of bingo calls may be retrieved, formatted for broadcast, and broadcasted, on the Internet. In addition, the system determines which players are eligible for a grand prize pool, and after the broadcast of the game, announces the grand prize winner.

To broadcast the animation sequence of the game, the bingo game generator may be connected to a broadcast interface 18 which formats the animation sequence data for broadcast via antenna 19 (FIGS. 1A and 1B). In this configuration, the broadcast interface is configured for RF transmission of television signals. The video is transferred in accordance with known RF transmission methods. Alternatively, the broadcast interface can be configured to format the video data for microwave transmission to satellites and reception by the public on conventional satellite dishes. In another alternative configuration, the broadcast interface can be configured to transmit the video along fiber optic cabling or on closed circuit television lines. According to another embodiment, the broadcast and/or communication with the vendor stations may be through either a wired or wireless connection to the Internet.

Similarly, in the embodiment corresponding to FIG. 1C, the video may be made accessible on demand to the clients through the WAN.

Figure 2B:
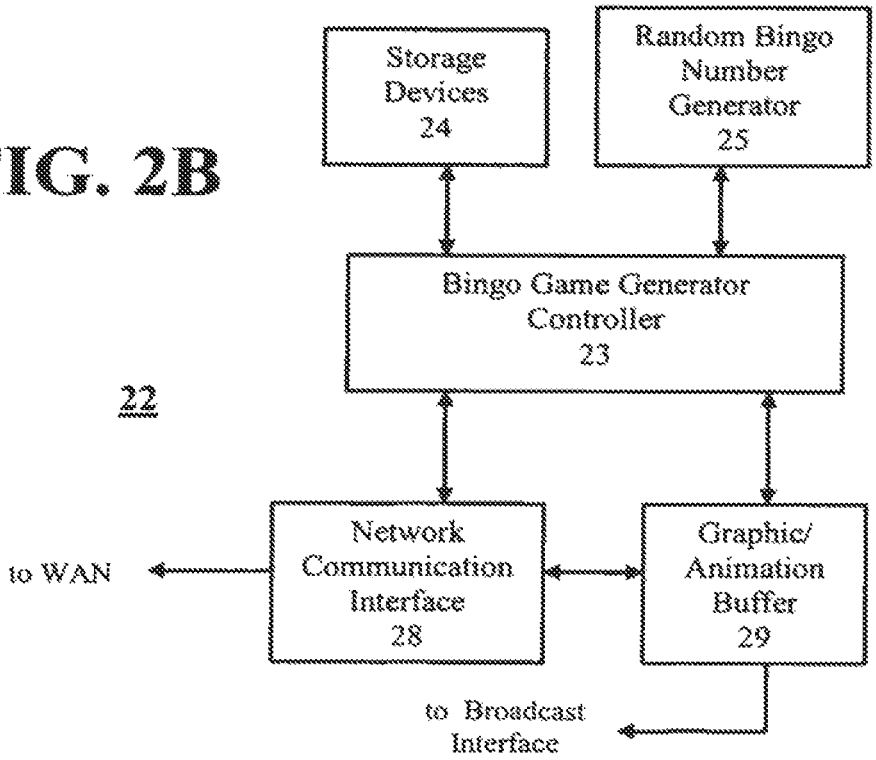
FIG. 2B is a block diagram of a bingo game generator, according to an exemplary embodiment of the present invention.

A bingo game generator according to one configuration will now be described with reference to FIG. 2B. Bingo game generator 22 preferably includes a microprocessor-based bingo game generator controller 23 and one or more storage devices 24. A random bingo number generator 25 (similarly to the random bingo number generator 21A in FIG. 2A) optionally may be included in the bingo game generator 22, for randomly selecting the drawn bingo numbers.

The bingo game generator controller 23, coupled with assorted software components, control operations and functionalities of the bingo game generator. The controller 23 may be a suitably programmed microprocessor or microcontroller, an application specific integrated circuit (ASIC), a programmable logic device, or (as one skilled in the art should understand and appreciate) a collection of discrete components suitably laid out and connected on a printed circuit board.

The software components may include hardware management functions, such as assorted device drivers, including a wireless communication driver if a wireless interface is provided.

In addition, the software components may include a user interface. The user interface provides means for managing and configuring the library of virtual images and animation elements offline. Further, a user, through the user interface, can customize the desired graphic elements (for example, logos, posted lottery results, etc.) to be displayed, as well as configure the animated drawing system.

The user can specify, through the user interface, that the animated bingo result is to be a compilation of video segments and animation sequence(s) and specify the timing of the video segments and animation sequences. For example, the animated lottery results may be announced and combined (such as spliced) with a winners' gallery video. Further, the user can specify that the animated bingo game video should be integrated with announcement of the lottery bingo result by a real person in one or more pre-recorded video segments. As another example, in the case of a state-run lottery, the animated lottery game may be preceded by video segments which present the benefits obtained by state residents from lottery revenue (such as public education, state and local governments, law enforcement, etc.).

More advanced tools for customizing the look and feel of the animated lottery result may also be provided through the user interface. For example, the user interface may provide means (in the form of well-known graphical interface elements, such as tables, menus, buttons, drop-down lists, tabs, etc.) for specifying and/or selecting the parameters for compositing (or blending) the animation elements and virtual images. The user interface may also be used to configure special effects to be displayed. In addition, the user interface may be used to reserve a window within the display (for example, a virtual picture-in-picture) for showing other information. Thus, for example, the reserved window may show sports scores, stock market indices, etc.

Any of many well-known animation and compositing techniques (not discussed in detail herein, in the interest of clarity) may be provided and configured through the user interface, such that one or more virtual overlays of graphical (or other visual) information may be presented.

In addition, the animated lottery bingo results may include one or more voice overlays and/or audio tracks. The user interface may also provide means for synchronizing the voice overlays and audio tracks with the animation sequences and video segments.

The storage devices may include one or a combination of buffers, registers and memories [for example, read-only memory (ROM), programmable ROM (PROM), erasable PROM (EPROM), electrically erasable PROM (EEPROM), non-volatile random access memory (NOVRAM), etc.]. Other storage devices may include, for example, floppy disk drive, CD (or DVD) drive, hard disk, and other mass storage devices. The storage devices may include a storage area network (SAN).

The storage devices store code and data for the bingo game generator controller 23. For example, the storage devices may store programs, such as system and application programs, and provide sufficient storage capacity also to store numerous animation sequences associated with the particular game.

The storage devices may also store an archive of lottery game results. Such archive may provide an audit trail which facilitates audits of the system. In addition to the storage devices, analysis tools may be provided. The combination of the archive and analysis tools provides means for obtaining statistics and historical data.

The bingo game generator 22 may operate through one or more wired or wireless networks and include a network communication interface 28 that is configured for bidirectional communications with the remote on-line vendor stations (and/or with a central station or lottery server). In a networked system, the network communication interface 28 may include interfaces for communicating electronically with one or more other terminals or data sources (for example, vendor stations or a lottery server) through telecommunication or computer networks. Such networks may include the Internet, an intranet, an extranet, a LAN (local area network), a WAN (wide area network), a wireless network, a satellite network and other networks. For example, video sequences may be downloaded through the networks from a remote source (for example, a storage area network or a server). As another example, the software components may be received through the network communication interface, and each software component may comprise one or more segments.

In one embodiment (FIG. 2B), the network communication interface 28 includes a microprocessor-based communication controller, memory for storing data (for example, data to be transferred via the network, and valid data received from the network for subsequent transfer to the game generator controller) and programs (such as system and application programs), one or more modems and corresponding serial interfaces (the controller is coupled to the modems via the serial interfaces). Depending upon the communication requirements of the system (i.e., the communication traffic), there may be a number of modems and corresponding serial interfaces to accommodate a large number of remote player stations. The serial interfaces provide a serial data buffer to the communication controller.

In any event, the network communication interface 28 includes the appropriate conventional units for interfacing with the networks, including, for example, Ethernet card, modem, wireless modem, etc. Interfaces for such communication are well known. Therefore, the interfaces are not described in detail here.

Animation may be accomplished in accordance with a number of computer generated animation techniques, such as the methods disclosed in U.S. Pat. Nos. 4,951,039, 4,873,585 and 4,752,836, whose disclosures are incorporated herein by reference.

After the sequence of drawn bingo numbers is randomly selected, by the random bingo number generator or by an operator, and the winning sequence of bingo calls is determined, the bingo game generator controller 23 retrieves a predefined video sequence of the bingo game from the storage devices 24 and prepares the video sequence for broadcast. The video sequence preferably comprises a plurality of stored segments. Thus, in the preferred embodiment, the bingo game generator controller randomly selects for each stage of the video sequence one of the segments appropriate for that stage, and composes the selected segments for each stage into a seamless video sequence.

The video data is preferably in digital form and may be formatted by, for example, a graphic/animation buffer 29 for transfer to the broadcast interface and/or to network communication interface 28.

In a preferred embodiment, segments are rendered directly to a digital compressed format such as MPEG 2. This allows the stored video image to be a very high quality. At the time of broadcast, the segments are concatenated together and fed to the broadcast interface which typically transmits a NTSC compatible analog signal. MPEG 2 is the same format used by satellite transmitters such as Direct TV. When the broadcast is via satellite, the MPEG 2 files may be transmitted directly without having to be converted (i.e. decompressed). Also, the data may be transmitted in serial digital format.

Generally, each remote on-line vendor station is configured for operation by an operator (for example, store personnel), or for operation directly by the player. For example, the player enters the bingo game parameters (such as by selecting one of a number of available bingo game cards or by specifying the desired bingo game numbers), and pays for the game at the site of the remote station. The entered bingo game parameters are also referred herein as "player selection data". It should be understood that the terms "player selection" and "player selection data" are used broadly herein to cover the various possible methods of selection of bingo game numbers, including Quick-Pick, player selection of one of a number of available game boards, specification of the bingo game numbers by the player, etc.

Figure 3:
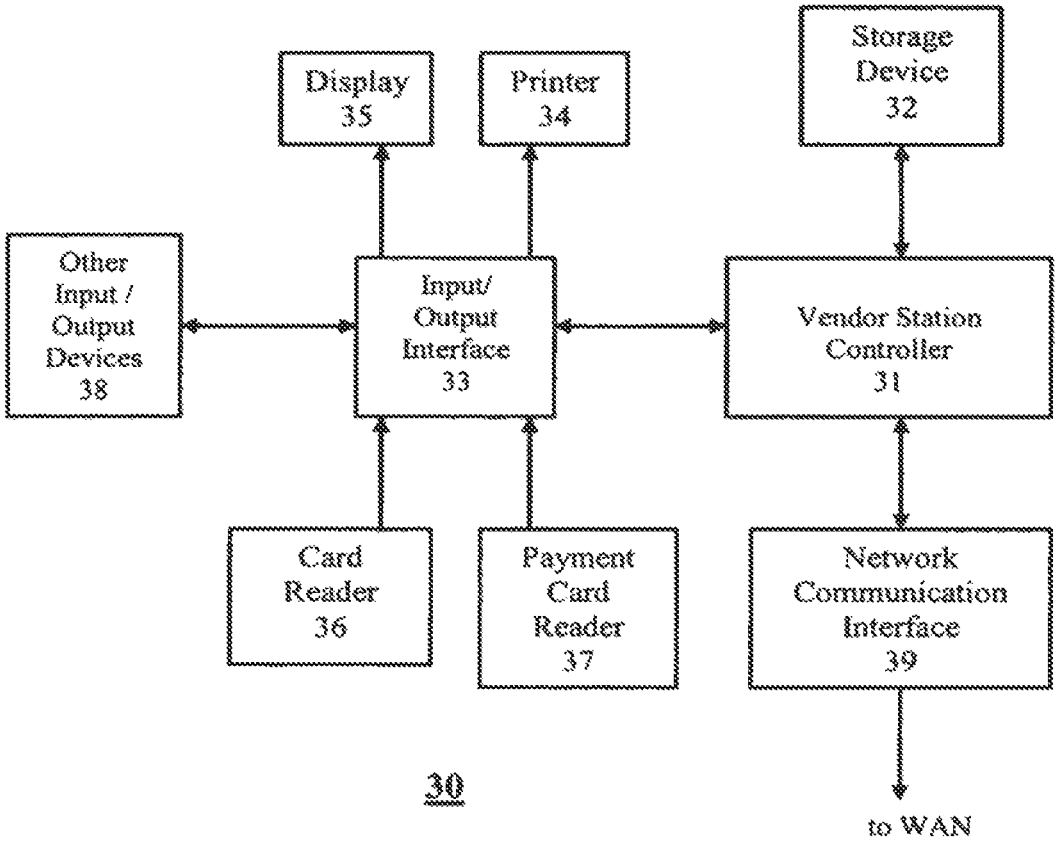
FIG. 3 is a block diagram of a remote station, according to an exemplary embodiment of the present invention.

FIG. 3 shows a block diagram of a remote on-line vendor station, according to an exemplary embodiment. Remote on-line vendor station 30 includes a controller-processor 31 connected to one or more storage devices 32 (such as RAM, ROM, other memory devices, and/or mass storage devices) for storing system and application programs. An input/output interface 33 couples the station controller 31 to assorted input/output devices, including a printer 34, a display 35 (such as a LCD display, a monitor and the like, to provide visual messages or prompts to the operator or player), a card reader 36, a payment card reader 37, or other input/output devices 38, such as keyboard, keypad, mouse, track ball, stylus, microphone, touchpad, touchscreen, speaker, etc., plus the appropriate device drivers.

As another example, a voice interface may be provided along with a microphone. Spoken words are picked up through the microphone and converted by applying speech recognition (software and/or hardware) technology. For example, a user, with visual prompt provided on the display, such as in the form of text and/or graphics, may give an oral command, which is then converted through speech recognition and triggers operation. Text-to-speech technology also may be integrated. Thus, a voice prompt also (or alternatively) may be provided.

Network communication interface 39 is connected to a wide area network and to the station controller 31 to facilitate data communication between the remote on-line vendor stations and the game generator, directly or via a central station.

The remote on-line vendor station may be configured for installation in, for example, a retail store and operated by personnel within the store. The player (or customer) selects, for example, the bingo game numbers and the operator can either enter the bingo game numbers via an input device such as a keyboard, a card reader or a voice interface, or elect the Quick-pick option for random selection of the numbers by a computer. Player selection data may be stored along with corresponding player identification data. The player identification data may be the player's social security number or other indicia which associate the player with the player selection data.

Figure 4:
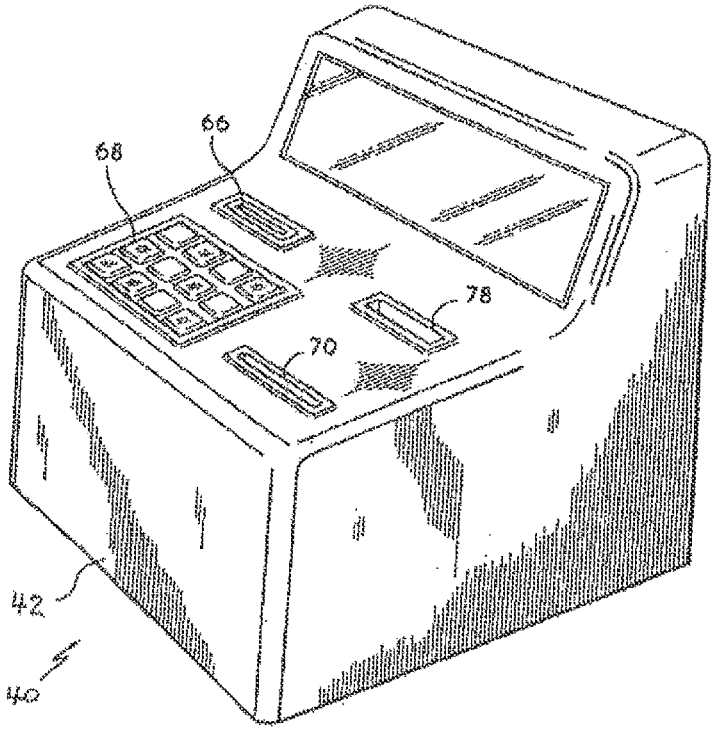
FIG. 4 is a perspective view of a kiosk-type remote station.

In an alternative configuration, a kiosk-type remote on-line station 40 is shown in FIG. 4. The internal components for the kiosk 40 are shown in FIG. 3. The kiosk 40 includes a stand alone housing 42 that may be located in public locations, such as shopping malls, and players can enter player selection data via an input device, such as a keyboard, a card reader, etc. In this embodiment, payment for the entry into the lottery may be made by cash or by a payment card medium, such as credit card, a debit card or the like, which is inserted into card reader 78. A ticket or receipt of the transaction is provided by the printer 34. It should be understood that the kiosk-type station may have many of the user interface features described above.

Figure 5:
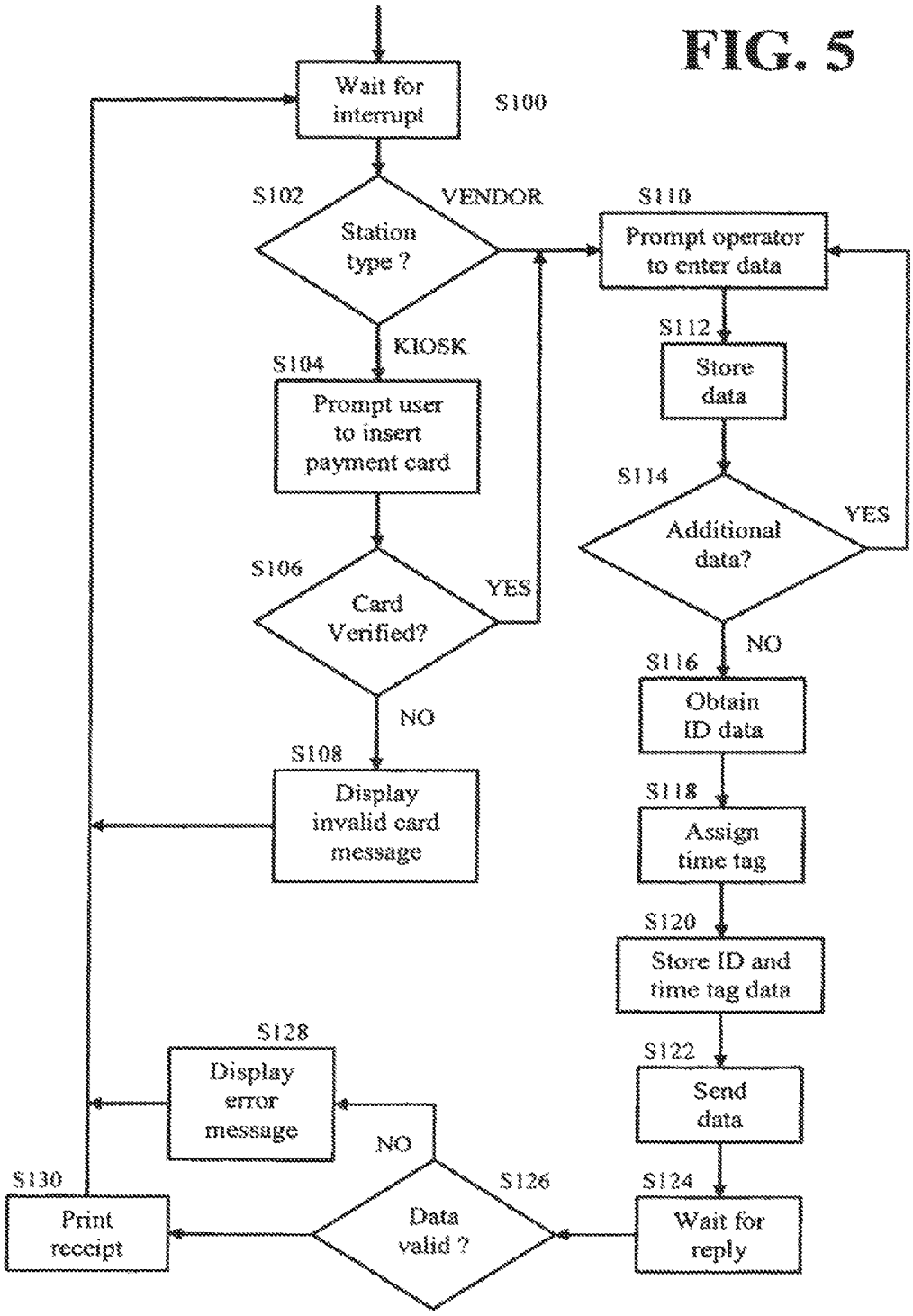
FIG. 5 is an exemplary flow diagram showing operation of the remote station of FIG. 3 or FIG. 4.

FIG. 5 is an exemplary flow diagram of the operation of the remote on-line vendor station. Initially, the remote station is maintained in an idle state in step S100 wherein the display 35 can be continuously updated to show, for example, statistical data and to provide instructions regarding how to enter player selection data. Once an interrupt is received by the station controller 31, the controller initiates a data entry routine. If the remote station is a kiosk (step S102, "KIOSK"), the player is prompted to insert a payment card into card reader 78 (step S104). The station controller 31 then verifies that the card is valid by, for example, automatically contacting known credit agencies via the network communication interface 39 and receiving a code indicating whether the card is valid or not (step S106). If the card is invalid (step S106, "NO"), then the player is notified (step S108) that the transaction cannot be completed and the station returns to the idle state (step S100). If the card is valid (step S106, "YES"), the player is instructed to enter the player selection data (step S110). If the remote station is operated by an operator, the station prompts the operator to enter the player selection data which as noted above can be entered by a keyboard, a card reader, or another input device (step S110).

In any event, when the player selection data is entered, the station controller 31 stores the data in the storage devices 32, typically in RAM (step S112). Once the player selection data is completely entered (step S114, "NO"), the controller 31 instructs the operator to enter identification data which is associated with the player selection data for verification purposes in the event the player (a) is a bingo game winner or (b) qualifies for and wins the grand prize (step S116). An example of player identification (ID) data is a social security number.

In addition to requesting player ID data, the station controller 31 retrieves the time of day and date (i.e., time tag data) from a clock (not shown) within the remote station (step S116) and associates the player selection data with a particular time and day for determining if the player has a winning ticket (step S118). The ID data and the time tag data are stored along with the corresponding player selection data (step S120).

Once the player selection data, the player ID data and the time tag data are stored, the data is sent to the bingo game generator, directly or through a central station, via the network communication interface 39 (step S122). If the remote on-line vendor stations are connected directly to the bingo game generator then data is sent to the bingo game generator over the WAN. After the data is transmitted to the bingo game generator, the remote station waits for the bingo game generator to reply that it received the player selection and associated ID and time tag data (step S124). If the reply is that the data received was invalid (step S126, "NO"), the operator or player is notified that a transmission error occurred (step S128) and the station returns to the idle state (step S100). If the reply is that the data transfer is complete (step S126, "YES"), the player selection data and associated ID and time tag data are printed on the printer 34 to provide the player with a receipt of the transaction which can be used by the player to claim any winnings (step S130). After the receipt is printed, the station returns to the idle state (step S100).

Figure 6:
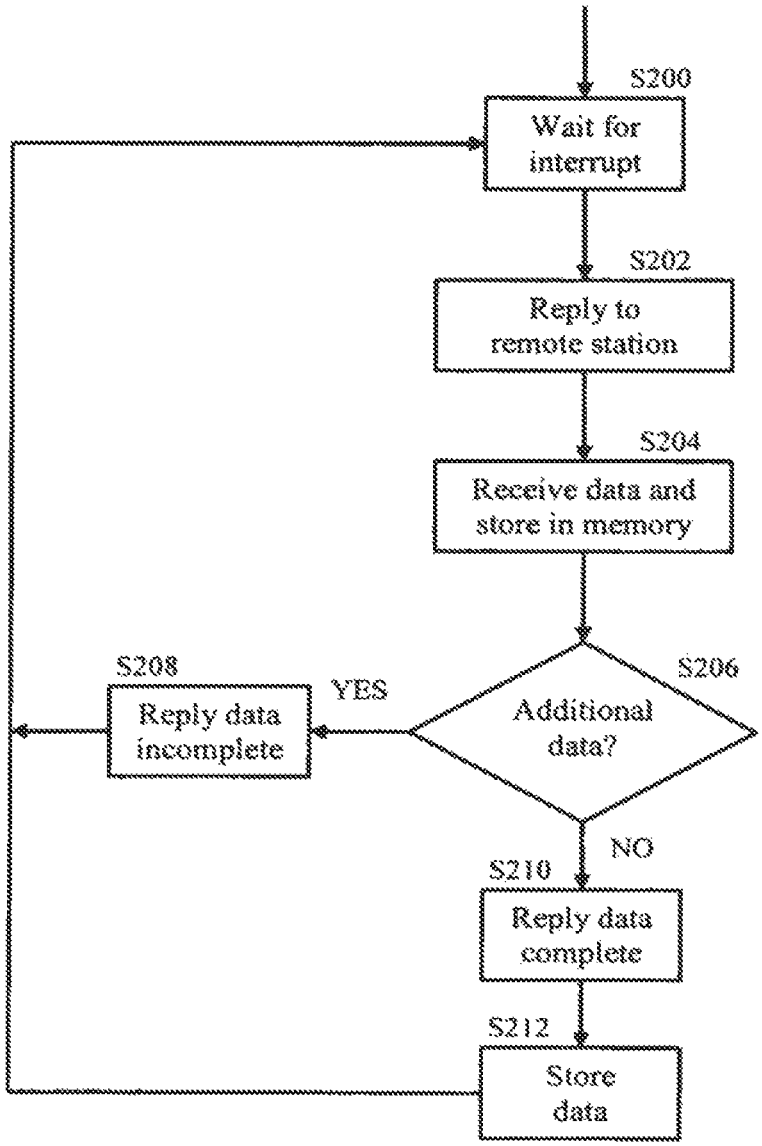
FIG. 6 is an exemplary flow diagram showing data transfer operation of the bingo game generator of FIG. 2A or FIG. 2B to receive player selection data from a remote station.

FIG. 6 is an exemplary flow diagram of the transfer of data to the bingo game generator. The bingo game generator is initially in an idle state (step S200) and upon receiving an interrupt performs the desired routine. The interrupt may be a request from the remote station to send player selection data to the bingo game generator. When the remote station requests data, the bingo game generator provides a reply indicating that the bingo game generator is or is not ready to receive the data (step S202). When the bingo game generator is ready to receive data, the remote station sends the data to the bingo game generator which stores the data in the network communication interface memory (step S204). The network communication interface controller determines if the data transaction is complete (step S206). If the data transaction is incomplete (step S206, "NO"), the bingo game generator replies to the remote station that the transaction is incomplete (step S208) and returns to the idle state (step S200). If the data transaction is complete (step S206, "YES"), the bingo game generator replies that the transaction is complete (step S210) and transfers the player selection, the ID and the time tag data to the storage device 24 (step S212).

Figure 7:
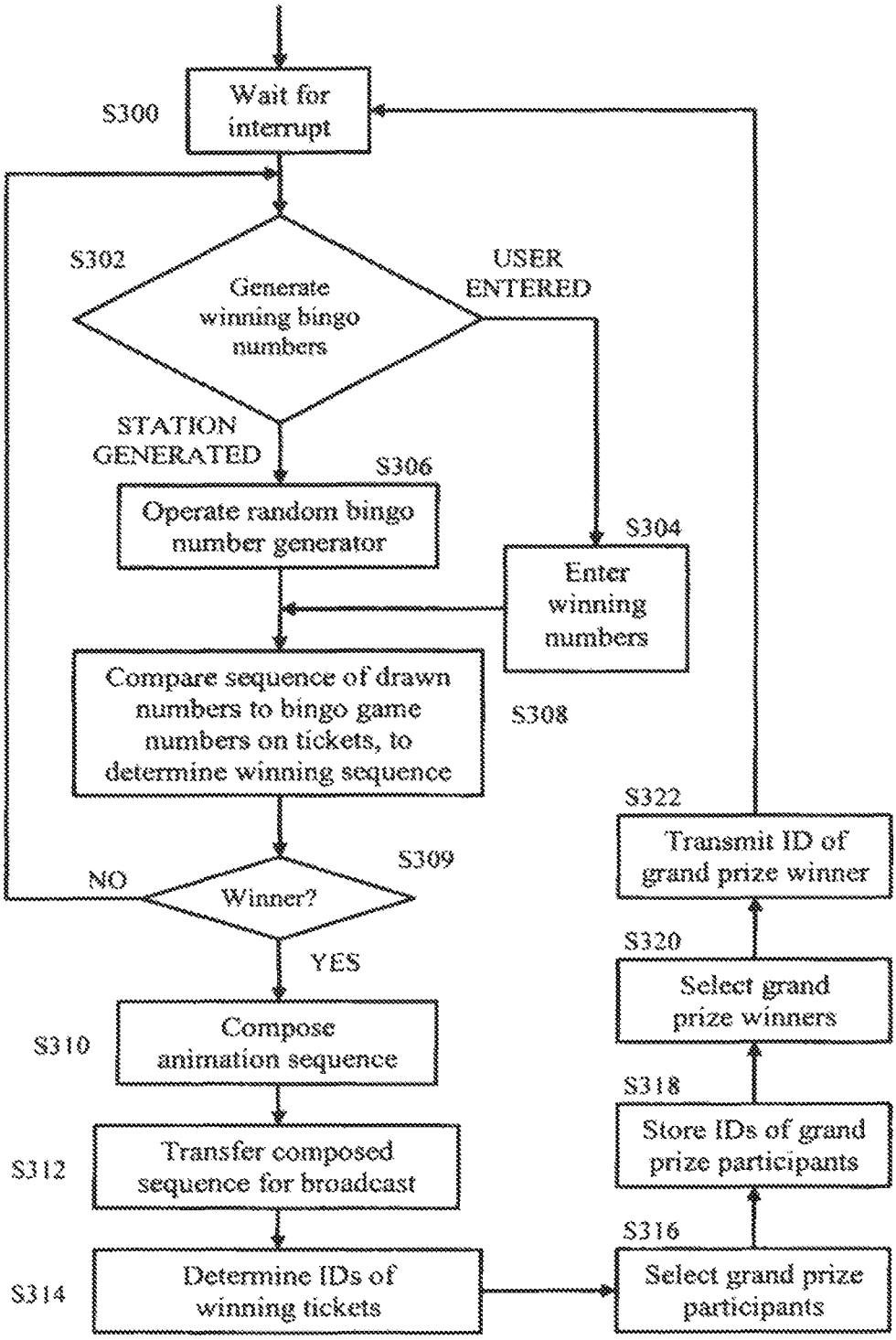
FIG. 7 is an exemplary flow diagram showing operation of the bingo game generator of FIG. 2A or FIG. 2B to generate lottery bingo results.

FIG. 7 is an exemplary flow diagram of the operation of the bingo game generator for generating the lottery bingo results. Initially, the bingo game generator is in an idle state (step S300) and upon receiving an interrupt (for example, an operator-selected start command), the generator determines a sequence of drawn bingo numbers for a particular game and winner(s).

The drawn bingo numbers can be randomly chosen and entered into the generator by an operator using a keyboard or another input device (step S302, "USER ENTERED", and step S304), or generated by random bingo number generator 25 (step S302, "STATION GENERATED", and step S306).

The bingo numbers are entered one at a time or each drawn bingo number is obtained by the bingo game generator, the controller 23 compares the resulting sequence of (presently and previously) drawn bingo numbers to the bingo game numbers on purchased tickets to determine a winning sequence of bingo calls (step S308).

After the winning sequence of bingo calls is determined (step S309), the controller 23 composes a video sequence having an outcome that corresponds to the winning sequence (step S310). As discussed above, the video sequence is preferably a seamless composition of animation elements (and/or video segments) randomly selected for corresponding stages of the video sequence.

The composed video sequence is then transferred (step S312) via the network communication interface or the broadcast interface for broadcast, as described above. Before broadcasting the video sequence, the bingo game generator determines the identity of winning tickets (step S314). The identity of winning tickets may be determined before, concurrently with or immediately after the winning sequence is determined.

The bingo game generator controller 23 then optionally determines which players qualify for the grand prize (step S316). For example, all players of the game may qualify for the grand prize. The identities of the grand prize participants may be stored in, for example, a grand prize data table (step S318) and the winner of the grand prize may be randomly selected through operation of the random bingo number generator 25 (step S320). After the winner of the grand prize is selected, the name of the winner(s) is broadcasted (step S322).

Although the subject matter of the present disclosure is explained exemplarily above using a virtual ball draw, it should be understood that the tools described herein may be adapted for other variations of an animated bingo drawings, with randomly selected results, which reduce drawing costs while increasing entertainment value to lottery players, as well.

Various modifications can be made to the embodiments of the present disclosure herein without departing from the spirit and scope thereof. For example, various types of network resources and protocols may be used for the wide area network and various central and remote station configurations may be employed. Likewise, various animation techniques may be used to animate the game through which the lottery winner is graphically portrayed, and various types of games may be adapted to animate the lottery game. Further, the animated lottery bingo game may be combined with a video announcement of the bingo game winner or sequence of drawn bingo number by a real person.

In addition, although the description of exemplary embodiments above refers to selection of numbers (as game parameters) and random selection of a sequence of drawn bingo numbers, it should be apparent that the embodiments may be readily adapted for selection of other types of game parameters, such as character, letters, symbols, etc.

Furthermore, the terms "ticket", "bingo ticket", "bingo card", "bingo board" are used broadly and interchangeably herein to denote any of the various possible media in which the bingo game numbers may be embodied. Thus, the bingo ticket, card or board may be akin to conventional bingo cards or boards, pre-printed instant lottery tickets, Lotto tickets printed on a printer after the desired numbers are selected, an electronic ticket which is associated with a corresponding ticket identifier and may or may not be printed at all, etc.

The above description should not be construed as limiting the disclosure, but merely as disclosing preferred embodiments thereof. Those skilled in the art can envision other modifications within the scope and spirit of the disclosure as defined by the claims appended hereto.

For example, additional variations may be apparent to one of ordinary skill in the art from reading U.S. application Ser. No. 09/900,235, filed Jul. 6, 2001, and U.S. application Ser. No. 10/218,155, now U.S. Pat. No. 6,592,454 filed Aug. 12, 2002, which are incorporated herein by reference.

A liability profile is the statistical representation of the likelihood that various numbers of players simultaneously win a given game. A traditional lottery game, such as a random drawing of a set of numbers that is matched against each player's pre-selected set of numbers, has a liability profile whereby it is very likely that a small number of players will simultaneously win the game. This liability profile allows for the possibility of a player winning an exceedingly large payout.

As stated above, because the liability profile of bingo may allow for a significant likelihood of a large number of players simultaneously winning a game, there is a desire to adapt the bingo game to a large-scale lottery while maintaining a liability profile that is desirable.

For example, it may be desirable to have a liability profile that makes it very likely that only one or a small number of players will simultaneously win a game.

Therefore, using bingo faces taken at random from the entire universe of possible combinations of random numbers is unlikely to generate a desirable liability profile when playing a traditional bingo game on a large-scale.

When bingo faces are created, a very specific pattern is applied. Five different numbers (usually at random) for each column (under the 'B', 'I', 'N', 'G', 'O'), with the very center square being replaced with the word "Free".

Since order is also important for most bingo games, with all 75 numbers available, there are over 552 septillion different possible cards (Approximately 552,446,474,061,129,000,000,000,000.).

However, this is actually a subset of the total number of cards that could be made by selecting 24 numbers from 75 where order is important. This would be almost 16 tredecillion (about 15,994,352,952,548,500, 000,000,000,000,000, 000,000,000,000)

Where order is not important (as in Blackout Bingo) the numbers become substantially smaller. There are just over 111 quadrillion (approximately 111,007,923,832,271,000) ways to make a bingo card and just under 26 quintillion (approximately 25,778,699,578,994,600) ways to select 24 numbers from 75.

Because bingo numbers are called one at a time from the entire range of numbers, the odds for getting a match are calculated by comparing the single card with the total range of possible cards that could be created from N numbers. While this is accurate for a single card, it does present problems with considering a group of cards not taken at random from the entire universe of possible combinations.

Figure 11:
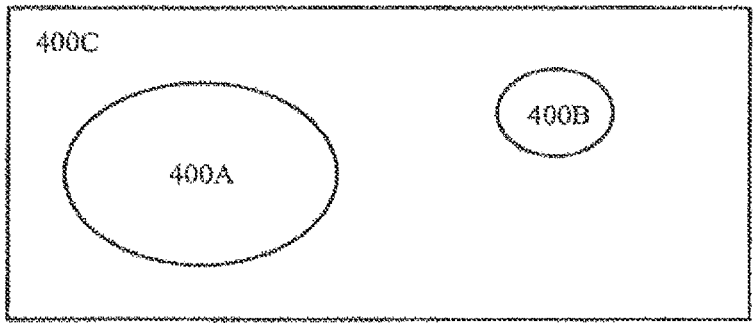
FIG. 11 is a block diagram showing probabilities involved in winning bingo.

FIG. 11 illustrates the probabilities involved in winning bingo. Area 400A represents the set of all possible bingo cards formed from combinations created from N numbers selected randomly from 75 (where order is not considered). Area 400B represents the set of all possible bingo cards (where order not considered). Area 400C is the universe of all possible combinations of 24 numbers from 75 numbers. Until such time as area 400A and area 400B overlap, it is impossible to have a winner in bingo until all 75 numbers have been called. The probability of such overlap is detailed in the following Table I.

TABLE I

| Chance of Calls | Intersection |
|---|---|
| 24 | 0.4306188% |
| 25 | 1.8716438% |
| 26 | 4.7826428% |
| 27 | 9.3524749% |
| 28 | 15.4811416% |
| 29 | 22.8496830% |
| 30 | 31.0224051% |
| 31 | 39.5412662% |
| 32 | 47.9934477% |
| 33 | 56.0489545% |
| 34 | 63.4734205% |
| 35 | 70.1240007% |
| 36 | 75.9357972% |
| 37 | 80.9045118% |
| 38 | 85.0690561% |
| 39 | 88.4961885% |
| 40 | 91.2680544% |
| 41 | 93.4727548% |

TABLE I-continued

| Chance of Calls | Intersection |
|---|---|
| 42 | 95.1976603% |
| 43 | 96.5250045% |
| 44 | 97.5292592% |
| 45 | 98.2758285% |
| 46 | 98.8206775% |
| 47 | 99.2105900% |
| 48 | 99.4838252% |
| 49 | 99.6710045% |
| 50 | 99.7961081% |
| 51 | 99.8774948% |
| 52 | 99.9288877% |
| 53 | 99.9602841% |
| 54 | 99.9787664% |
| 55 | 99.9891998% |
| 56 | 99.9948142% |
| 57 | 99.9976725% |
| 58 | 99.9990361% |
| 59 | 99.9996380% |
| 60 | 99.9998798% |
| 61 | 99.9999660% |
| 62 | 99.9999923% |
| 63 | 99.9999987% |
| 64 | 99.9999999% |
| 65 | 100.0000000% |

Before 24 calls, no winning bingo face is possible and after 65 calls, at least one winning bingo face must be possible.

Given that only standard bingo faces are created, the set of possible faces is only about 0.5% of the size of the entire universe of combinations that are possible. For an individual face, this does not matter. The odds of matching a face to a list of numbers remain constant. However, when considering the expectation of a winner within the entire group, the issue of whether there could possibly be a winner becomes important.

For example, the expected number of winners for 1,000,000 faces all playing the same Blackout bingo game are as follows:

TABLE II

| Calls | Probability (as %) of Winner |
|---|---|
| 24 | 0.000000038747% |
| 25 | 0.000000931033% |
| 26 | 0.000011637579% |
| 27 | 0.000098414883% |
| 28 | 0.000666130861% |
| 29 | 0.003774657713% |
| 30 | 0.018427165368% |
| 31 | 0.078998488031% |
| 32 | 0.305198282094% |
| 33 | 1.077824299058% |
| 34 | 3.474501768472% |
| 35 | 9.983571098380% |
| 36 | 23.520886785618% |
| 37 | 36.427002732468% |
| 38 | 22.759581200883% |
| 39 | 2.343641825477% |
| 40 | 0.005814540758% |
| 41 | 0.000000002578% |
| 42 | 0.000000000000% |
| 43 | 0.000000000000% |

However, this chart assumes the faces are generated using the entire universe of possible combinations of 24 numbers. Bingo faces are a tiny subset of this space (less than ½200.sup.th).

To see how this works, consider what happens when 36 numbers are drawn. For 1,000,000 faces, the likelihood is 36% least one of the faces will match 24 of the numbers drawn. However, there is also a 24% chance (100-76%) that the current selection of numbers does not have the ability to match any bingo faces.

The probability of a winner at 36 calls is not the product of the two probabilities because they are not independent events. If the current pattern of drawn numbers does not have the ability to match a bingo card, then the probability of a match is 0%. When the current numbers do create a pattern that can match a bingo face, the expected chance of winners will be greater than 36%.

As more numbers are drawn, if it remains impossible to create a bingo face from the selected numbers, the probability increases that several players will be depending upon the same number to complete the Blackout. For example, suppose for a moment that 63 numbers have been drawn . . . all 15 B's, all 15 I's, all 15 G's, all 15 O's and 3 of the 15 N's. Obviously, this is very unlikely (perhaps once in 80 million games), but if it were to happen, on the very next number, approximately 733 players would all have Blackout.

For additional prizes, the following would be likely:

| | |
|---|---|
| 1 Number Away | 32,234 |
| 2 Number Away | 241,758 |
| 3 Number Away | 483,517 |
| 4 Number Away | 241,758 |
| 5 or more numbers away | 0 |

This is rare, but the phenomenon will occur to a lesser degree with some frequency. This is due to the extremely large number of bingo faces in play (1,000,000). Most bingo games have only a minute fraction of this, and therefore the likelihood, of an impossible combination, drops to about 0% long before there is any reasonable expectation for winners.

Furthermore, this phenomenon wreaks havoc upon subsidiary prizes. Where the normal expectation might be a few hundred or even a thousand winners with up to 3 numbers away, the above scenario shows a situation where more than ¾ of the players have a win. And if a special prize is given to faces that are the furthest away, the remaining ¼ all qualify.

Traditional bingo does not have secondary prizes. When looking at options for lottery style subsidiary prizes, the fact that bingo can involve a significant variance in the number of numbers called, causes an expediential increase in prizes as the number of numbers called increases.

Therefore, a major problem with adapting bingo to a large-scale lottery with such a large player base, is the potential to have prizes that are split among a very large number of players potentially resulting in prize values of only a few pennies. To avoid this, a "Progressive" style of bingo game may be employed. The progressive style may not use the normal winning patterns of Bingo, namely, single horizontal, vertical, or diagonal line. In the progressive style, the third and second prizes may be awarded first while the players move towards the main prize. The first pattern could be, for example, the X followed by "Sputnik" and finally the Blackout.

In this approach, Bingo would play as any regular game. The first player(s) to achieve an X receives a share of the 3.sup.rd prize, the first player(s) to achieve a "Sputnik" receives a share of the 2.sup.nd prize, and the first player(s) to achieve a Blackout gets a share of the top prize, as described in detail above and shown in FIGS. 9A, 9B, and 9C respectively.

Letter X may be won very quickly, in 8 or 9 calls 95% of the time. Sputnik would take 16 calls, and would be won between 20 and 26 calls 99% of the time. Blackout would be won last going in 30 to 40 calls approximately 99% of the time.

There would be three independent draws and each draw would play against a different face on the card. The first draw would be played against only the top face on all cards. The second draw would be played against the middle face on all cards. And the third draw would be played against the bottom face on all cards. To keep the game exciting, games may be started during a time when players are most likely to be attentive, for example, at 7:30 PM, and the games may be played sequentially, for example, from 7:30 PM to 8:00 PM. In each draw, players may be given a chance to win one of four prizes.

In using this progressive approach, the following liability profile, as described in terms of typical prize values, may be achieved. This table assumes a population base of 60 million people, with 1% sales per capita/draw, $2.00 bet resulting in sales of $1.2 Million, 3 games and a 60% Prize Pay-out:

TABLE III

| Blackout Game | | Calls | Prize Pool (%) | Pool ($) | Expected Wins | Expected Prize Values |
|---|---|---|---|---|---|---|
| 3rd Prize | Letter X | 8-10 | 2.5% of Sales | $30,000 | 1 to 5 winners | $6,000 to $30,000 each |
| 2nd Prize | Sputnik | 20-26 | 5.0% of Sales | $60,000 | 1 to 2 winners | $30,000 to $60,000 each |
| 1st Prize | Blackout | 30-40 | 10.0% of Sales | $120,000 | 1 winner | $120,000 each |
| Promotion | Various | N/A | 2.5% of Sales | $30,000 | 15,000 winners | $2.00 each |

Nine (9) prizes may be awarded to players in the first 3 prize groups. With the last prize being used for different promotions including, but not limited to:

1. Weekly winners picked from the blackout winners to travel to Las Vegas to attend Powerball Game show
2. Randomly picked from total player base
3. Randomly picked from registered Internet users
4. Determine the number of people 1, 2, and 3 calls away, then figure out which number gives "winners" within defined criteria (i.e., 15,000 $2 winners), and announce that at the beginning of the game.

The bingo cards have three faces on each card. This allows for a number of different playing methods:

1. All three faces are played separately, with each face being for a different independent game;

2. All three faces are played together in the same game; and

3. All three faces are played together in the same game, but prizes are awarded to the winners by face.

In the first method, there would be three independent draws and each draw would play against a different face on the card. The first draw would be played against only the top face on all cards. The second draw would be played against the middle face on all cards. And of course, the third draw would be played against the bottom face on all cards.

In each draw, players would have a chance to win one of three prizes.

Typical prize values (assuming sales of $2 Million, 3 games and a 60% prize pay-out) are shown in the chart below:

TABLE IV

| Blackout Game | | Calls | Prize Pool (%) | Pool ($) | Expected Wins | Expected Prize Values |
|---|---|---|---|---|---|---|
| 3rd Prize | Letter X | 8-10 | 2.5% of Sales | $50,000 | 1 to 5 winners | $10,000 to $50,000 each |
| 2nd Prize | Sputnik | 20-26 | 5.0% of Sales | $100,000 | 1 to 2 winners | $50,000 to 100,000 each |
| 1st Prize | Blackout | 30-40 | 12.5% of Sales | $250,000 | 1 winner | $250,000 each |

Here, nine (9) prizes would be awarded to players.

In the second method, there would be only one draw played against all three faces on the card. Players would have three chances to win. This is similar to real Bingo as players tend to play many cards at once.

Typical Prize Values (Assuming Sales of $2 Million, 1 game and a 60% Prize Pay-out) are shown in the chart below:

TABLE V

| Blackout Game | | Calls | Prize Pool (%) | Pool ($) | Expected Wins | Expected Prize Values |
|---|---|---|---|---|---|---|
| 3rd Prize | Letter X | 8-10 | 7.5% of Sales | $150,000 | 1 to 5 winners | $30,000 to $150,000 each |
| 2nd Prize | Sputnik | 20-26 | 15.0% of Sales | $300,000 | 1 to 2 winners | $150, 000 to $300,000 each |
| 1st Prize | Blackout | 30-40 | 37.5% of Sales | $750,000 | 1 winner | $750,000 each |

Here, three (3) prizes would be awarded to players.

In the third method, there would be only one draw played against all three faces on the card. However, prizes would be awarded to the first player to match a pattern on each of the three different faces. The top face, the middle face and the bottom face.

For each face, players would have a chance to win one of three prizes.

Typical Prize Values (Assuming Sales of $2 Million, 3 games and a 60% Prize Pay-out) are shown in the chart below:

TABLE VI

| Blackout Game | | Calls | Prize Pool (%) | Pool ($) | Expected Wins | Expected Prize Values |
|---|---|---|---|---|---|---|
| 3rd Prize | Letter X | 8-10 | 2.5% of Sales | $50,000 | 1 to 5 winners | $10,000 to $50,000 each |
| 2nd Prize | Sputnik | 20-26 | 5.0% of Sales | $100,000 | 1 to 2 winners | $50,000 to 100,000 each |
| 1st Prize | Blackout | 30-40 | 12.5% of Sales | $250,000 | 1 winner | $250,000 each |

Here, nine (9) prizes would be awarded to players. The odds for each player winning each prize are one in one million. Odds for bingo are based upon sales, as the game always continues until there is a winner.

The progressive approach discussed above is one method by which bingo may be adapted to large-scale lottery according to an embodiment of the present disclosure.

Other embodiments of the present invention may be used to adapt a more classic style of bingo to large-scale lottery while still obtaining a desirable liability profile. Examples of more classic styles of bingo may include the normal winning patterns of bingo, namely, single horizontal, vertical, or diagonal line, 4 corners, or postage stamp.

For example, bingo faces may be predetermined, rather than randomly generated thus allowing liability to be fixed. There are four distinct approaches to predetermining bingo faces.

The first fixed liability approach is the fixed-instant approach. Here, each ticket would contain all of the necessary information, both bingo cards and caller balls, to create, in essence, an electronic instant bingo ticket.

A specified number of the tickets may be created, for example, 100 million. These tickets would be distributed, for example, in subsets or subpools, to each participating lottery. The total prize structure will be based on, for example, 100 million tickets which would continually be distributed and sold until the "game" runs out.

Just as in a traditional instant win-type lottery game, the players would purchase tickets at a retail location and could learn immediately to determine if the ticket is a winning ticket. However, for additional entertainment, the player could go to the Internet, access a website and enter the validation or serial number information. At that time, an animation system would methodically play the ticket and would display the results. As in the case of an instant ticket, the validation number or barcode from the ticket could be used to validate the ticket value.

The second fixed liability approach, the pool/subpool approach, uses a pool/subpool system to generate the universe of possible plays and winning cards. A pool is a predetermined set of bingo cards available for sale to the public containing both winning and non-winning cards and may be designed to meet game design specifications.

The base form of the pool/sub-pool design is in essence a drawing to determine the winning set (or sub-pool) of bingo cards. The pool of bingo tickets as well as each set of bingo caller balls necessary to create the specified prize structure for each sub-pool would be pre-determined. The pool set may be sufficiently large such that no duplicate serial numbers are necessary.

A specific programming method may be used to ensure the desired number of winners are created by the bingo caller balls.

The bingo generation software generates bingo cards according to parameters specified by the user. Each card contains 24 numbers in the range 1 to 75 and there can be up to six cards per "entry". Entries can be combined on a ticket if multiple games are required.

Unique entry identifiers and ticket identifiers can also be generated, typically six to eight digit numbers. Software may be used to generate number sets from which the actual bingo cards are derived. There are four sets: bases, triggers, neutrals and controls. All of the bases must be present in the bingo caller balls before any winners can be triggered.

Each trigger number may have an associated number of winning tickets. The game operator may determine how many winners are required and will include the appropriate mix of triggers to create the specified number of winners. The number of winners per trigger may be determined at the data generation stage.

The neutrals do not trigger any winners. These numbers can also be used simply to increase the play-action or cross-off on the tickets. The higher the cross-off, the more anticipation is created during game play.

The controls should not be among the caller balls. These are required for the generation of losers.

The cards may be made up as follows. Losing cards may contain one or more control numbers plus a selection of numbers from other sets to make up the 24. Because control numbers are never among the displayed caller balls, the player can never complete the grid. Hence the grid loses.

Winning cards comprise 23 base numbers and one trigger number. All of the base numbers are displayed so the player will cross off at least 23 numbers. To create winners, the game operator will display only those triggers that create the correct number of winners.

The next approach, the constrained approach, may be used to enhance the game play to make it appear more random. Here, a card deck algorithm is used to generate random-feeling card decks that have the desired liability distribution. In this approach, the draws would occur just like a normal bingo game, where the numbers 1 to 75 will be drawn in random order. To "limit" the payout to the desired liability profile, the bingo cards number layout will be constrained and/or built to get close to the payout desired. This will provide the following characteristics of fixed liability within a random bingo draw:

Churn amounts at lower levels (regular bingo)

Evenly distributed payouts to jurisdictions

Minimize "unexpected" large payout groups

To accomplish this, "genetic programming" may be used to generate card decks. Genetic programming is a method for computer programming that is modeled on biological evolution. In genetic programming, computer programs may be automatically designed from a set of solutions (represented by chromosomes) called population. Solutions from one population are taken and used to form a new population. This is motivated by a hope, that the new population will be better than the old one. Solutions which are selected to form new solutions (offspring) are selected according to their fitness, the more suitable they are the more chances they have to reproduce.

This process is repeated until some condition (for example number of populations or improvement of the best solution) is satisfied.

Genetic programming, as described in various publications written by J. R. Koza, such as, Koza, J. R. (1990), Genetic Programming: A Paradigm for Genetically Breeding Populations of Computer Programs to Solve Problems, Stanford University Computer Science Department technical report STAN-CS-90-1314; Koza, J. R. (1992), Genetic Programming: On the Programming of Computers by Means of Natural Selection, MIT Press; Koza, J. R. (1994), Genetic Programming II: Automatic Discovery of Reusable Programs, MIT Press; Koza, J. R., Bennett, F. H., Andre, D., and Keane, M. A. (1999), Genetic Programming III: Darwinian Invention and Problem Solving, Morgan Kaufmann, Koza, J. R., Keane, M. A., Streeter, M. J., Mydlowec, W., Yu, J., Lanza, G. (2003), Genetic Programming IV: Routine Human-Competitive Machine Intelligence, Kluwer Academic Publishers, all incorporated by reference, holds that genetic programming achieves the goal of automatic programming (also sometimes called program synthesis or program induction) by genetically breeding a population of computer programs using the principles of Darwinian natural selection and biologically inspired operations. The operations include reproduction, crossover (sexual recombination), mutation, and architecture-altering operations patterned after gene duplication and gene deletion in nature.

Genetic programming is a domain-independent method that genetically breeds a population of computer programs to solve a problem. Specifically, genetic programming iteratively transforms a population of computer programs into a new generation of programs by applying analogs of naturally occurring genetic operations. The genetic operations include crossover (sexual recombination), mutation, reproduction, gene duplication, and gene deletion.

In order to implement genetic programming, the human user communicates the high-level statement of the problem to the genetic programming system by performing certain well-defined preparatory steps.

The five major preparatory steps for the basic version of genetic programming require the human user to specify:

1. The set of terminals (e.g., the independent variables of the problem, zero-argument functions, and random constants) for each branch of the to-be-evolved program;
2. The set of primitive functions for each branch of the to-be-evolved program;
3. The fitness measure (for explicitly or implicitly measuring the fitness of individuals in the population);
4. Certain parameters for controlling the run; and
5. The termination criterion and method for designating the result of the run.

Genetic programming typically starts with a population of randomly generated computer programs composed of the available programmatic ingredients. Genetic programming iteratively transforms a population of computer programs into a new generation of the population by applying analogs of naturally occurring genetic operations. These operations are applied to individual(s) selected from the population. The individuals are probabilistically selected to participate in the genetic operations based on their fitness (as measured by the fitness measure provided by the human user in the third preparatory step). The iterative transformation of the population is executed inside the main generational loop of the run of genetic programming.

The executional steps of genetic programming (that is, the flowchart of genetic programming) are as follows:

1. Randomly create an initial population (generation 0) of individual computer programs composed of the available functions and terminals.
2. Iteratively perform the following sub-steps (called a generation) on the population until the termination criterion is satisfied:
   a. Execute each program in the population and ascertain its fitness (explicitly or implicitly) using the problem's fitness measure.
   b. Select one or two individual program(s) from the population with a probability based on fitness (with reselection allowed) to participate in the genetic operations in (c).
   c. Create new individual program(s) for the population by applying the following genetic operations with specified probabilities:
      i. Reproduction: Copy the selected individual program to the new population.
      ii. Crossover: Create new offspring program(s) for the new population by recombining randomly chosen parts from two selected programs.
      iii. Mutation: Create one new offspring program for the new population by randomly mutating a randomly chosen part of one selected program.
      iv. Architecture-Altering Operations: Choose an architecture-altering operation from the available repertoire of such operations and create one new offspring program for the new population by applying the chosen architecture-altering operation to one selected program.
3. After the termination criterion is satisfied, the single best program in the population produced during the run (the best-so-far individual) is harvested and designated as the result of the run. If the run is successful, the result may be a solution (or approximate solution) to the problem.

The constrained bingo card deck may be developed by cycling through the universe of potential cards, assigning each card into specific pools/sub-pools based on the potential draw order.

As this "evolution" occurs, consideration will be given for: control numbers, "live" numbers, winning patterns to be played, occurrence of numbers within pools/sub-pools, and etc.

A criterion for success may be a deck of bingo cards whereby when any set of random numbers (bingo balls) are selected, the resulting prize structure should result especially within the first tier, the regular bingo awards which may be, for example, a free game.

Another criterion for success may be the degree of potential liability to overpay within the prize structure. The goal may be to have this liability at 0% staying within the defined payout, such as the recommended 60%.

A three phased implementation may be used to achieve the desired results:

Phase 1: Researching the extent of the problem and the relative solution base;

Phase 2: Executing the genetic programming solution based on the results of phase 1; and Phase 3: Extensive execution of the bingo game generator software to play the game based on the card decks generated in phase 2 and analyze the payout based on the defined prize structure.

In phase 1, Architecture-Altering Operations is an approach to genetic programming that may be used. In this approach, the architecture of the solution is evolved dynamically and automatically during the run of genetic programming in the sense of actually creating new architectures and altering existing architectures during the run. This approach may be used with automatically defined functions allowing the genetic programming run to define the proposed architecture. This will allow for predicting the potential success and determine whether to proceed to phases 2 and 3.

Before applying genetic programming to a problem using Architecture-Altering Operations, it may be helpful to perform preparatory steps. These steps involve determining:

1. The set of terminals for each branch;
2. The set of functions for each branch;
3. The fitness measure;
4. The parameters for controlling the run; and
5. The result designation method and termination criterion.

Since automatically defined functions may be used, an additional preparatory step may concern the architecture of the evolving program. The sub-steps may involve:

a. the number of function-defining branches;
b. the number of arguments possessed by each function-defining branch; and
c. if there is more than one function-defining branch the nature of the hierarchical references (if any) allowed between the function-defining branches. In making the architectural choices that will be useful for this specific problem, we may use five methods based on:
   1. Prospective analysis of the nature of the problem;
   2. Seemingly sufficient capacity (overspecification);
   3. Affordable capacity;
   4. Retrospective analysis of the results of actual runs; and
   5. Evolutionary selection of the architecture.

In phase 2, Executing the Genetic Programming Solution Based, the steps for executing the genetic programming, after Phase 1, may include:

1. Generate an initial random population of computer programs.
2. Iteratively perform the following sub-steps until the termination criterion has been satisfied:
   a. Execute each program in the population and assign it (explicitly or implicitly) a fitness value according to how well it solves the problem.
   b. Select program(s) to participate from the population;
   c. Create new program(s) for the population by applying genetic operations such as reproduction, crossover, mutation, and branch and argument modifications.
3. After satisfaction of the termination criterion (which usually includes a maximum number of generations to be run as well as a problem-specific success predicate), the single best computer program in the population produced during the run (the best-so-far individual) is designated as the result of the run. This result may (or may not) be a solution (or approximate solution) to the problem.

In phase 3, Extensive execution of the bingo game generator software, using the best computer program defined from Phase 2, we will create bingo card deck sets for actual testing and verification of potential payouts. Our existing bingo game generator will be used with our random number generator producing the bingo ball draw sets. The bingo game generator can compare 100 million card decks a second with each ball drawn. The bingo game generator will be modified to continually cycle through the various ball draw sets, recording results for detailed analysis.

The next fixed-liability approach is the pari-mutuel approach. This approach may work in all game play patterns, but may be especially useful for non-standard bingo patterns. With a pari-mutuel play, the "regular bingo" patterns may result in an extensive number of winners which will cause the pari-mutuel payout to be very low when distributed mutually across the winners. A method to control this has been implemented by the Ontario Lottery where the bingo cards were created such that there were never two bingo cards sold with the same number in the same place. This will reduce the occurrence, but not negate the effect completely. The deck may be constrained in this manner, and the constraints may be extended even further to ensure that the churn value of regular bingo remains within desired boundaries. Although it may change on a day-to-day basis, this approach may enable the closest feel to a real bingo game. This approach may be particularly effective when combined with the progressive approach discussed above.

Figure 12:
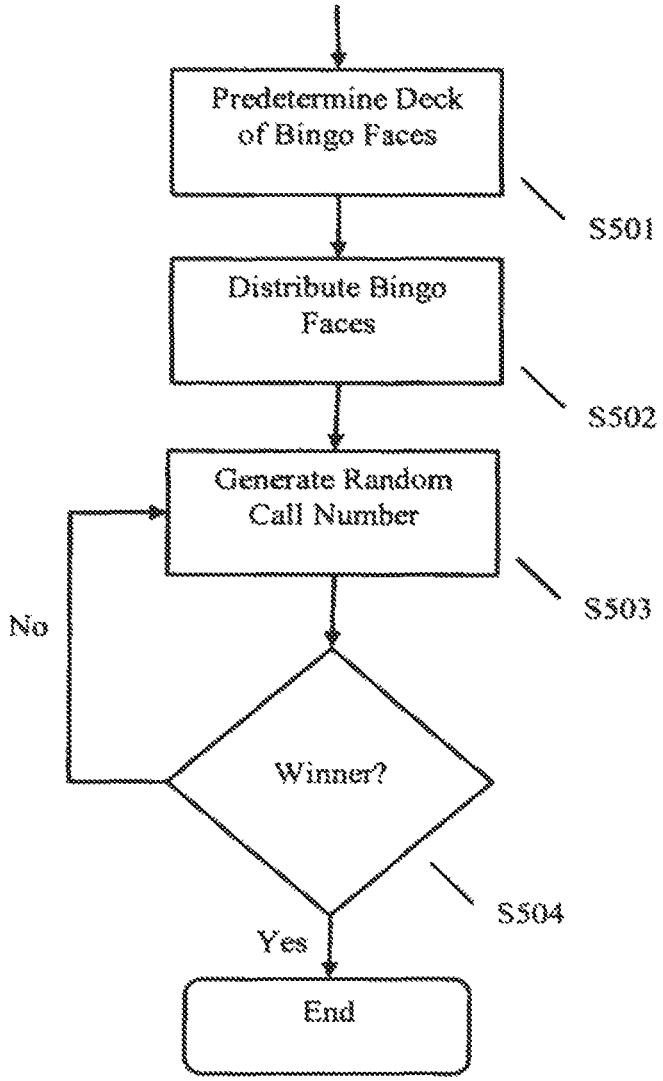
FIG. 12 is a flow chart showing a method for adapting a game of bingo to a lottery according to an embodiment of the present invention.

FIG. 12 is a flow chart showing a method for adapting a game of bingo to a lottery according to an embodiment of the present invention. First, a plurality of bingo faces are predetermined to achieve a desired liability profile (Step S501). Next, one or more of the plurality of bingo faces are distributed (Step S502). A random call number is generated (Step S503). If a desired pattern is not achieved on one or more of the distributed bingo faces (No, Step S504) then the next call number is generated (Step S503). The method ends when a desired pattern is achieved on one or more of the distributed bingo faces (Yes, Step S504).

Figure 13:
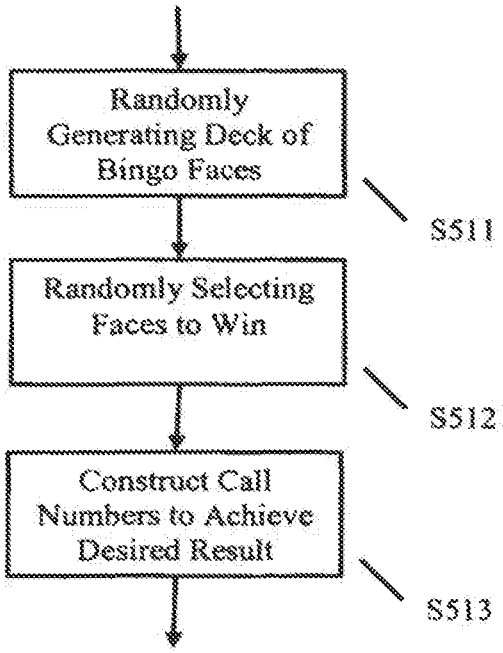
FIG. 13 is a flow chart showing a method for adapting a game of bingo to a lottery according to another embodiment of the present invention.

FIG. 13 is a flow chart showing a method for adapting a game of bingo to a lottery according to another embodiment of the present invention. First, a plurality of bingo faces are randomly generated (Step S511). Then, one or more bingo faces from the plurality of bingo faces are selected to become winning faces to achieve a desired number of wining faces (Step S512). Finally, a set of call numbers that allow the selected faces to win is constructed (Step S513).

Figure 14:
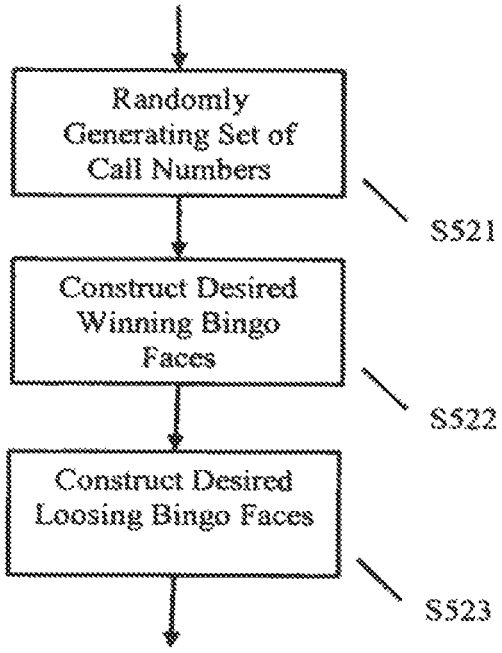
FIG. 14 is a flow chart showing a method for adapting a game of bingo to a lottery according to another embodiment of the present invention.

FIG. 14 is a flow chart showing a method for adapting a game of bingo to a lottery according to another embodiment of the present invention. First, a set of call numbers is randomly generated (Step S521). Next, a desired number of winning bingo card faces are constructed based on the generated set of call numbers (Step S522). Finally, a desired number of losing bingo card faces are constructed based on the generated set of call numbers (Step S523).

It is to be understood that while embodiments of the present invention have been described in terms of adapting bingo to a computerized lottery system, the techniques herein described could be used to adapt bingo to other modalities such as, for example, electronic gaming machines that may be made available on a casino floor, or internet gaming generally. Additionally, the techniques herein described could be used to adapt similar games-of-chance for lottery play.

What is claimed is:

1. A computer-implemented method for adapting a game of bingo to a lottery, comprising:

randomly generating a plurality of bingo faces;

randomly selecting one or more bingo faces from the plurality of bingo faces to become winning faces to achieve a desired overall payout liability profile for the lottery, wherein the selection is conducted free of player influence; and constructing a set of predetermined call numbers that allow only the selected winning faces to win so as to achieve the liability profile.

2. The method of claim 1, wherein the step of randomly generating a plurality of bingo faces to achieve a desired liability profile comprises using genetic programming to generate the plurality of bingo faces.

3. The method of claim 2, wherein using genetic programming to generate the plurality of bingo faces, comprises: randomly generating a plurality of potential bingo cards; determining the potential liability of the plurality of potential bingo cards; and evolving the plurality of potential bingo cards until a desired potential liability is achieved.

4. The method of claim 3, wherein evolving the plurality of potential bingo cards includes reproducing, crossing over, mutating, or architecture-altering.

5. The method of claim 1, wherein the desired liability profile maximizes the likelihood that one or more prizes are won by a small number of players.

6. The system of claim 5, wherein the one or more distribution units distribute the bingo faces by printing game cards.

7. The system of claim 5, wherein the one or more distribution units distribute the bingo faces by displaying on-screen game play either on-site or over the internet.

8. A computer-implemented method for adapting a game of bingo to a lottery, comprising:

randomly generating a set of call numbers;

constructing a desired number of winning bingo card faces based on the generated set of call numbers; and constructing a desired number of losing bingo card faces based on the generated set of call numbers, wherein the winning bingo card faces and the losing bingo card faces are determined free of player influence and are constructed so as to achieve an overall payout liability profile for the lottery.

9. A system for adapting a game of bingo to a lottery, comprising:

a bingo face generating unit for randomly generating a plurality of bingo faces;

a selection unit for randomly selecting one or more bingo faces from the plurality of bingo faces to become winning faces to achieve a desired overall payout liability profile for the lottery, wherein the selection is conducted free of player influence; and a call number set construction unit for constructing a set of predetermined call numbers that allow the selected winning faces to win.

10. The system of claim 9, wherein the bingo-face generating unit uses genetic programming to generate the plurality of bingo faces.

11. The system of claim 10, wherein using genetic programming to generate the plurality of bingo faces, comprises: randomly generating a plurality of potential bingo cards; determining the potential liability of the plurality of potential bingo cards; and evolving the plurality of potential bingo cards until a desired potential liability is achieved.

12. The system of claim 11, wherein evolving the plurality of potential bingo cards includes reproducing, crossing over, mutating, or architecture-altering.

13. The system of claim 9, wherein the desired liability profile maximizes the likelihood that one or more prizes are won by a small number of players.

* * * * *